US006770592B2

(12) United States Patent
Suzuki et al.

(10) Patent No.: US 6,770,592 B2
(45) Date of Patent: Aug. 3, 2004

(54) REVERSIBLE THERMOSENSITIVE RECORDING MEDIUM AND IMAGE PROCESSING METHOD USING THE SAME

(75) Inventors: Kazumi Suzuki, Shimizu-machi (JP); Yoshihiko Hotta, Mishima (JP); Kunichika Morohoshi, Numazu (JP); Nobuyoshi Sugiyama, Numazu (JP); Satoru Sampei, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 65 days.

(21) Appl. No.: 10/085,841

(22) Filed: Feb. 26, 2002

(65) Prior Publication Data

US 2003/0092571 A1 May 15, 2003

(30) Foreign Application Priority Data

Feb. 26, 2001 (JP) ..... P2001-050298

(51) Int. Cl.[7] ..... B41M 5/40
(52) U.S. Cl. ..... 503/201; 503/200; 503/226
(58) Field of Search ..... 503/200, 201, 503/226

(56) References Cited

U.S. PATENT DOCUMENTS

| | | | | |
|---|---|---|---|---|
| 5,158,924 | A | 10/1992 | Konagaya et al. | |
| 5,278,128 | A | 1/1994 | Hotta et al. | 503/207 |
| 5,321,239 | A | 6/1994 | Masubuchi et al. | 235/380 |
| 5,448,065 | A | 9/1995 | Masubuchi et al. | 250/316.1 |
| 5,489,494 | A | 2/1996 | Hotta et al. | 430/19 |
| 5,538,822 | A | 7/1996 | Hotta et al. | 430/19 |

(List continued on next page.)

FOREIGN PATENT DOCUMENTS

| | | |
|---|---|---|
| GB | 2320582 A | 6/1998 |
| JP | 55054198 | 4/1980 |
| JP | 55154198 | 9/1980 |
| JP | 54119377 | 5/1981 |
| JP | 63221087 | 9/1988 |

(List continued on next page.)

OTHER PUBLICATIONS

U.S. application No. 09–877140, filed on Jun. 8, 2001.
U.S. application No. 09–737130, filed on Dec. 14, 2000.

*Primary Examiner*—B. Hamilton Hess
(74) *Attorney, Agent, or Firm*—Cooper & Dunham LLP

(57) ABSTRACT

A reversible thermosensitive recording medium comprising at least a reversible thermosensitive recording layer provided on a supporting substrate and, a protective layer provided on the recording layer, wherein the recording layer is arranged so as to develop a first color therein when it is heated to a specific temperature level between a second temperature and a third temperature which is higher than the second temperature and then cooled to a first temperature level between normal temperature and the second temperature which is higher than the normal temperature, while so as to develop a second color therein when it is heated to another temperature level more than a fourth temperature which is higher than the third temperature and then cooled to a particular temperature which is lower than the first temperature, and the protective layer contains at least a lubricant showing the melting point ranging from higher than or equal to the first temperature to lower than or equal to the second temperature and has a surface roughness (Rz) (where Rz represents an average rise on the surface by ten measurements) of 1.2 $\mu$m or more. The recording medium eliminates the gap of air formed between the thermal printing head and the surface, thus heat conductivity is elevated allowing uniform application of thermal energy during the erasing action thereby its erasing property is improved, while the surface smoothness is improved as for as during the heating action at high temperatures, resulting an excellent thermal head matching, and the storage capability therefor is improved.

22 Claims, 6 Drawing Sheets

U.S. PATENT DOCUMENTS

| | | | | |
|---|---|---|---|---|
| 5,556,827 | A | 9/1996 | Nogiwa et al. | 503/201 |
| 5,583,554 | A | 12/1996 | Masubuchi et al. | 347/171 |
| 5,616,262 | A | 4/1997 | Itoda et al. | 219/216 |
| 5,635,319 | A | 6/1997 | Hotta et al. | 430/19 |
| 5,686,382 | A | 11/1997 | Suzuki et al. | 503/201 |
| 5,747,413 | A | 5/1998 | Amano et al. | 503/201 |
| 5,869,422 | A | 2/1999 | Kazumi et al. | 503/201 |
| 5,880,445 | A | 3/1999 | Mori et al. | 235/380 |
| 5,948,727 | A | 9/1999 | Hotta et al. | 503/200 |
| 5,952,263 | A | 9/1999 | Suzuki et al. | |
| 6,060,425 | A | 5/2000 | Morohoshi et al. | 503/200 |
| 6,172,001 | B1 | 1/2001 | Hotta et al. | 503/201 |

FOREIGN PATENT DOCUMENTS

| | | |
|---|---|---|
| JP | 2188293 | 7/1990 |
| JP | 2258287 | 10/1990 |
| JP | 3169590 | 7/1991 |
| JP | 4247985 | 9/1992 |
| JP | 4267190 | 9/1992 |
| JP | 5092658 | 10/1992 |
| JP | 5124360 | 5/1993 |
| JP | 6210954 | 12/1993 |
| JP | 8156410 | 6/1996 |
| JP | 8156110 | 12/1997 |

REVERSIBLE THERMOSENSITIVE RECORDING MEDIUM AND IMAGE PROCESSING METHOD USING THE SAME

BACKGROUND OF THE INVENTION

1. Field of the Invention

The present invention relates to a reversible thermosensitive recording medium, and particularly a reversible thermosensitive recording material in which information on primarily a thermosensitive (recording) layer can repeatedly be written and erased by reversibly changing the transparency or the color tone of image information subjecting to the change of temperature.

2. Description of the Related Art

Reversible thermosensitive recording materials have recently been focused where image information is temporarily recorded or written and when not needed, erased or eliminated. For example, there is known a characteristic reversible thermosensitive recording medium, in which a particles of an organic monomeric material such as higher molecular weight of fatty acid is dispersed into a matrix resin having a low glass transition temperature (Tg) such as vinyl chloride-vinyl acetate copolymer which have a glass transition temperature (Tg) from 50 or 60° C. to lower than 80° C. (as disclosed in Japanese Unexamined Patent Publications of Tokkai Shou 54-119377 and Tokkai Shou 55-54198).

Also, there is known another thermosensitive recording composition, and recording material using it as disclosed in Japanese Unexamined Patent Publication of Tokkai Hei 5-124360, where a color developing action is effected using a coloring reaction between an electron-donor as a coloring compound (referred to as a colorant or leuco dye hereinafter) and an electron-acceptor compound (referred to as a developer hereinafter), in which, as the developer to be used in combination with the leuco dye as the colorant, an organic phosphoric compound, an aliphatic carboxyllic acid compound, or a phenollic compound, those all have a long chain fatty acid hydrocarbon group or groups, are employed, thereby an easy development and erasing of color image are realized, and as a result, both coloring and de-coloring actions can easily be performed under given heating and cooling conditions, also, both colored and de-colored states can be held stable at the normal temperature. Moreover, the coloring and the de-coloring courses can be repeated in stable cycles. Subsequently, of such phenol compound having long chain aliphatic acid hydrocarbon group or groups, a particular compound having specific constitution was proposed for actual utilizing (by Japanese Unexamined Patent Publication of Tokkai Hei 6-210954).

However, when the conventional reversible thermosensitive recording mediums being capable of repeating the coloring and the de-coloring are used under the actual operating conditions for printing and erasing, they often are likely to produce print blanks or erasing stains and fail to provide a satisfactory level of coloring and de-coloring performance. This results from sticking phenomenon and the like which caused by poor head matching of the recording layer of the recording medium to heating members such as thermal head or heat block, thereby allows no uniform heat supply to the all area to be heated of recording layer through the heating members. Also, there may be developed a gap of air between the thermal member and the surface of the reversible thermosensitive recording medium, and the gap interrupts the uniform heating.

Disclosed in Japanese Unexamined Patent Publication of Tokkai Shou 63-221087 is an improvement for eliminating the foregoing drawbacks of the conventional recording medium where an over-coating layer of silicon resin or silicon rubber is over-coated onto the surface of the recording medium to minimize the friction coefficient thereof. The over-coating layer is however insufficient in the bonding strength for the thermosensitive recording layer and may peel off the recording layer through a series of mechanical movements thus declining the quality of reproduced images. Also, other designs are disclosed in Japanese Unexamined Patent Publications (Tokkai Hei)5-092658 and (Tokkai Shou)63-317385 where a protective layer impregnated with a phosphazene resin or a silicon resin is used for improving the resistive to wear and lowering the friction coefficient or in Japanese Unexamined Patent Publication (Tokkai Hei)5-092658 where the protective layer contains long chain fatty acid or its alkyl ester, long chain dibasic fatty acid and its alkyl ester which serve as a lubricant. Each design however fails to improve the head matching of a reversible thermosensitive recording medium at high temperatures and may hence be disadvantageous in that the recording layer is injured when the image-erasing action is repeated a number of times and thus enables no uniform erase.

Disclosed in Japanese Unexamined Patent Publication (Tokkai Hei)8-156410 is a protective layer having a defined level of glossiness and a defined degree of surface roughness for improving the head matching and thus minimizing the injury throughout a series of the erasing actions. This however increases the gap of air developed between the thermal printing head and the surface of the reversible thermosensitive recording medium, thus permitting no uniform thermal printing. Particularly, if the temperature rising is limited to a given range, more erasing errors may be developed during the erasing action.

SUMMARY OF THE INVENTION

It is hence an object of the present invention to provide a reversible thermosensitive recording medium having improved characteristics in thermal head matching which minimize the erasing faults and ensure the stable erasing actions, and an excellent storage capability.

We have studied for overcoming the foregoing disadvantages and developed a novel reversible thermosensitive recording medium in which the gap of air between the thermal printing head and the surface of the recording medium is eliminated thus heat conductivity is improved allowing uniform application of thermal energy during the erasing action thereby erasing property is improved, while the surface smoothness is improved as for as during the heating action at high temperatures, resulting an excellent thermal head matching, and the storage capability therefor is improved too.

Above and other objects of the present invention are achieved by: (1) a reversible thermosensitive recording medium comprising at least a reversible thermosensitive recording layer provided on a supporting substrate and, a protective layer provided on the recording layer, wherein the recording layer is arranged so as to develop a first color therein when it is heated to a specific temperature level between a second temperature and a third temperature which is higher than the second temperature and then cooled to a first temperature level between normal temperature and the second temperature which is higher than the normal temperature, while so as to develop a second color therein when it is heated to another temperature level higher than a fourth temperature which is higher than the third temperature and then cooled to a particular temperature which is lower than the first temperature, and the protective layer contains at least a lubricant showing the melting point ranging from higher than or equal to the first temperature to lower than or equal to the second temperature and has a surface roughness (Rz) (where Rz represents an average rise on the surface by ten measurements) of 1.2 μm or more;

(2) a reversible thermosensitive recording medium according to the paragraph (1) wherein the protective layer is being crosslinked;

(3) a reversible thermosensitive recording medium according to the paragraphs (1) or (2), wherein the lubricant is particles having particle size smaller than or equal to the thickness of the protective layer;

(4) a reversible thermosensitive recording medium according to any one of the paragraphs (1) to (3), wherein the content (percent by weight) of the lubricant in the protective layer is higher than or equal to 0.1 and lower than 10.0;

(5) a reversible thermosensitive recording medium according to any one of the paragraphs (1) to (4), wherein the protective layer contains a filler having an oil absorption capacity of 20 ml/100 g or higher;

(6) a reversible thermosensitive recording medium according to any one of the paragraphs (1) to (5), wherein the surface roughness (Rz) of recording side of the reversible thermosensitive recording medium is less than or equal to 5.0 μm;

(7) a reversible thermosensitive recording medium according to any one of the paragraphs (1) to (6), wherein the surface roughness (Rz) of recording side of the reversible thermosensitive recording medium ranges from 1.5 μm to 5.0 μm;

(8) a reversible thermosensitive recording medium according to any one of the paragraphs (1) to (7), wherein the surface roughness ratio (Sm/Rz) (where the Sm represents a smoothness by the distance on average between each projections) of the reversible thermosensitive recording surface of the reversible thermosensitive recording medium ranges from 30 to 120;

(9) a reversible thermosensitive recording medium according to any one of the paragraphs (1) to (8), wherein the strength, which complying to JIS K5400-1990, of the surface film coated on the recording side of the reversible thermosensitive recording medium is higher than or equal to the F;

(10) a reversible thermosensitive recording medium according to any one of the paragraphs (1) to (9), wherein the recording medium has a multiplicity of layers consisting of a supporting substrate layer, thereon interposed a reversible thermosensitive recording layer, thereon interposed an intermediate layer, and thereon interposed a protective layer;

(11) a reversible thermosensitive recording medium according to any one of the paragraphs (1) to (10), wherein all resin materials of recording layer and of thereon provided all layers are a resin or resins which is or are capable of crosslinking;

(12) a reversible thermosensitive recording medium according to any one of the paragraphs (1) to (11), wherein at least one of the layers of the reversible thermosensitive recording medium contains at least one type of filler;

(13) a reversible thermosensitive recording medium according to the paragraph (12), wherein the filler in the reversible thermosensitive recording medium is an inorganic filler;

(14) a reversible thermosensitive recording medium according to any one of the paragraphs (1) to (13), wherein the reversible thermosensitive recording medium further comprising information memory means;

(15) a reversible thermosensitive recording medium according to the paragraph (14), wherein the information memory means are at least one selected from a group consisting of a magnetic recording layer, a magnetic stripe, an IC memory, and an optical memory, which are accommodated at least a part in the medium;

(16) a reversible thermosensitive recording medium according to any one of the paragraphs (1) to (15), wherein the supporting substrate comprises two or more different sheets being bonded together;

(17) a reversible thermosensitive recording medium which comprises a reversible thermosensitive recording portion having a reversible thermosensitive recording medium according to any one of the paragraphs (1) to (13), a supporting substrate, substrate, and thereon provided an adhesive layer; and;

(18) a reversible thermosensitive recording medium according to any one of the paragraphs (1) to (17), wherein a hard image or images is or are being printed on one or both of the upper and lower sides of the reversible thermosensitive recording medium.

Also, the objects of the present invention are achieved by; (19) a reversible thermosensitive recording method, wherein the method utilizes a reversible thermosensitive recording medium according to any one of the paragraphs (1) to (18), as a point card, a prepaid card, a clinic card, an entrance card, or a commuter ticket.

Moreover, the objects of the present invention are achieved by; (20) an image forming method for a reversible thermosensitive recording medium, wherein a reversible thermosensitive recording medium according to any one of the paragraphs (1) to (18) is heated for developing and/or erasing image;

(21) an image forming method for a reversible thermosensitive recording medium according to the paragraph (20), wherein a thermal head is employed as the printing means; and;

(22) an image forming method for a reversible thermosensitive recording medium according to the paragraph (20), wherein the image-erasing means are one of selected from at least a thermal head, a ceramic heater, a heat control, a hot stamp, and a heat block.

The thermosensitive recording medium of the present invention is made of a material that occurs a reversible visual change by temperature changes. Such a visual change may be categorized into color variation and shape variation. The visual change in the material concerned to the present invention involves color variation. The color variation may be determined by optical transparency, reflectivity, light-absorption by wavelength, light scattering degree, and other optical characteristics of light. In fact, the reversible thermosensitive recording medium of the present invention can display the information by means of a combination of those characteristics. To be more tangible, the material in the present invention may be any one with no limitation, as for as it can reversibly be varied in the transparency or color tone with heating, an example is instanced by a material which causes a visual change with a temperature change thereof from the normal temperature, prevailing variation in the material of the present invention may be color variation.

For example, an embody of the material used in the present invention is instanced as a material which may develop a first color when it having been heated to a third level of the temperature which is higher than a second level and then cooled down to a first level which is lower than the second level and higher than the normal level, while the material can be turned to a second color when it having been heated to a fourth level of the temperature which is higher than the third level and cooled down to the first level or lower.

In particular, of the material, a material is preferably employed where it shifts from a color developed when it having been heated to a temperature level ranging higher than the second level and lower than the third level and then cooled down to the first level which is lower than the second level and higher than the normal level, to another color developed when it being heated to the temperature to the fourth level then cooled down to the first level or lower. Characteristic examples of the material include a material, as disclosed in Japanese Unexamined Patent Publication of Tokkai Shou 55-154198, becomes transparent when having been heated to a temperature which is higher than a second level and lower than a third level then it is cooled down to a first level which is lower than the second level and higher than the normal level while turns to a white opaque state by heating to a fourth level and cooling down to the first level or lower, a material, as disclosed in Japanese Unexamined Patent Publications of Tokkai Hei-225996, Tokkai Hei 4-247985, and Tokkai Hei 4-267190, develops a color when it having been heated to a fourth level of the temperature and cooled down to a first level which is lower than a second level and higher than the normal level and disappears the color by heating to a temperature higher than the second level and lower than the third level and cooling down to the first level or lower, a material, as disclosed in Japanese Unexamined Patent Publication of Tokkai Hei 3-169590, is white opaque when having been heated to a temperature level which is higher than a second level and lower than a third level and cooled down to a first level which is lower than the second level and higher than the normal level and turned to a transparent state by heating to a fourth level and cooling down to the first level or lower, and a further material, as disclosed in Japanese Unexamined Patent Publications of Tokkai Hei 2-188293 and Tokkai Hei 2-188294, develops a black, red, or blue colors when it having been heated to a temperature level which is higher than a second level and lower than a third level and cooled down to a first level which is lower than the second level and higher than the normal level and de-colores by heating to a fourth level and cooling down to the first level or lower. Out of those materials, following two materials are instanced as typical examples.

Namely, one material is a material variable in optical density (transparency), while another is a material variable in color tone. As a material of a thermosensitive layer which can reversibly be switched between the transparent state and the white opaque state, a layer of an organic monomeric material such as higher alcohol or higher fatty acid dispersed into a resin base such as polyester is typically denoted. Another material, in which the color of dye and the like can reversibly be changed, can be denoted as a highly sensitized thermosensitive recording material of leuco type.

The thermosensitive recording layer which can be varied to the transparency is primarily made from such a material which comprises an organic monomeric material dispersed into a resin base. This reversible thermosensitive recording material has a range of temperatures to be made transparent, as will be described later in more detail. The reversible thermosensitive recording material according to the present invention utilizes a change of the transparency (between the transparent state and the white opaque state), and mechanism thereof may be assumed, but not restricted to, as below reason.

(I) At transparent state, particles of the organic monomeric material are tidily dispersed into the resin base so as to produce close contact between particle of organic monomeric material and the resin without making a gap in interface thereof while each particle has no void therein, whereby light incident from one side of the layer will not be diffused but transmitted directly to the other side. (II) White opaque state is implemented by the effect of gap developed between the particles of the organic monomeric material and resin base, and void developed between the particles of the organic monomeric material which being in the structure of crystallized or aggregated, whereby light incident from one side of the layer will be diffused and refracted on the interface between the gap and the particle, between the gap and resin base, intra void of particles, and interface between crystals or aggregations, and so on.

FIG. 1 illustrates a profile of the transparency by temperature change. As shown, a thermosensitive layer including a resin base and therein dispersed an organic monomeric compound may be in a milky, white opaque state when it is at normal temperature which is lower than $T_0$.

As the layer is heated up, it starts turning to a transparent state from temperature $T_1$ gradually, and becomes transparent at a temperature range from $T_2$ to $T_3$. The layer remains transparent when the temperature is lowered from this state to normal temperature state which is lower than $T_0$. This is thought as a consequence of that the resin base begins to soften from temperature $T_1$., and with progressing the softening, the reduction in volume of the resin base is also progressed, thereby both the gap at inter surface of the organic monomeric compound particle and resin base, and the void in intra particles are decreased, therefore the level of transparency is gradually increased. At the temperature range from $T_2$ to $T_3$, the organic monomeric material is turned to a semi-liquidated state, and the remaining voids are filled with the organic monomeric material of the semi-liquidated state, this contributes to the elevation of transparency. When the layer with seed crystals still remained therein is cooled down, they are crystallized at a relatively high temperature, at the time, the resin remaining softened favorably may responds to a change in the shape and volume of each particle being crystallized, hence developing transparency with no voids. As a result, the transparent state can be maintained.

When the layer is further heated up to higher than temperature $T_4$, it turns to a semi-transparent state between the full transparent state and the white opaque state. Then, as the layer is cooled down, its semi-transparent state is not turned to transparent state, but turned to the milky, white opaque state same as that of the first step. This is thought as a consequence of that the organic monomeric material is melted at the temperature higher than $T_4$, thereafter it causes a supercooled state, then results from the rapid crystallization of the organic monomeric material at slightly higher than $T_0$. At the time, the resin fails to follow a volume change of the organic monomeric material caused by the crystallization, thus developing voids. It should be noted that the profile of the relationship between the temperature and the transparency shown in FIG. 1 is simply a characteristic example and may be varied depending on the materials used and its transparency level.

In that case, the temperature $T_1$ is the first specific temperature level, $T_2$ is the second specific temperature level, and $T_3$ is the third specific temperature level. As the energy for actual printing is needed for sufficient saturation of the printing density, the fourth specific temperature level according to the present invention is a temperature level for printing which may be 5 to 20% higher than $T_4$.

It is hence apparent for providing the above characteristics that the diameter of the particles of the organic monomeric material is not smaller than the wavelength of visible light. Also, if the diameter of the particles is too large, the reversible shifting action will be difficult. It is hence known that the diameter of the particles is preferably 0.3 to 5 $\mu$m and more preferably 0.5 to 3 $\mu$m. More particularly, the content (%) of the organic monomeric material per unit weight in the thermosensitive recording layer ranges preferably from 6% to 70% and more preferably ranges from 15% to 50%. If the content is too small, the shift to the transparent state will be difficult. If too large, the formation of the thermosensitive recording layer will be difficult. The content may be calculated by Equation 1.

$$\text{Content}(\%)=(\text{Mass of material per unit weight in layer/weight of layer})\times 100 \qquad \text{Equation 1}$$

The reversible thermosensitive recording material according to the present invention concludes the reversible thermal color developing reaction between an electron-donor coloring compound and an electron-acceptor compound in thermosensitive the layer. This will be then described below. The electron-donor coloring compound and the electron-acceptor compound for the coloring developing reaction, when they are combined by heating and melting, produce a thermal color developing mixture which is an amorphous composition. On the other hand, when the amorphous composition is heated by a temperature lower than that of the heating and melting process, the electron-acceptor compound crystallizes, thus eliminating the color developed by the color developing reaction.

FIG. 2 illustrates a profile of the coloring density with heat. As shown, the composition of the colorant and the developer according to the present invention is turned to an amorphous state thereof thus to develop a color when heated to higher than T4', and remains stable when rapidly cooled down to T1'. Also according to the present invention, when the composition at the amorphous state is heated to a temperature for non-melting range from T2' to T3', the developer is crystallized and released from its co-dissolved state with the colorant. As a result, the developer and the colorant are separated from each other. As the developer is separated from the colorant by its crystallization and inhibited to receive electrons from the colorant, the color is eliminated. In that case, T1' is the first specific temperature level, T2' is the second specific temperature level, and T3' is the third specific temperature level. As the energy for actual printing is needed for sufficient saturation of the printing density, the fourth specific temperature level according to the present invention is a temperature level for printing which may be 5 to 20% higher than T4'.

The resin material in the thermosensitive layer of the reversible thermosensitive recording medium also serves as a binding material. The electron-donor coloring compound is a colorless or pale color dye precursor which is not limited to but may be selected from triphenyl-methane-phthalide compounds, fluoran compounds, pheno-thiazine compounds, leuco auramine compounds, and indolino-phthalide compounds. The electron-acceptor compound may be selected from long chain alkyl phosphonic acid, long chain alpha-hydroxy fatty acid, long chain alkyl-thiomalic acid, and long chain alkyl-malonic acid.

The specific temperature levels T1, T2, T3, T4, T1', T2', T3', an T4' will be determined by the following procedure.

The procedure starts with proving a reversible thermosensitive recording medium of the second color. As appropriate, the medium of the first color or the medium of close to the second color is heated with thermal energy applied from a thermal head to preliminarily develop the second color. The energy for printing is determined through having been increased in steps to print a pattern of gradation. Then, the level of the energy for developing the second color is selected. The verification of that if the selected energy level is one for developing the second color may be implemented by heating up the medium with a level of energy which is slightly (e.g. 5%) higher than the selected energy. When the density of the second color is found not different between the two levels, it proves that the selected level is the energy level for developing the second color. If the higher density of the second color is developed by application of the selected energy level, it proves that the preceeded energy level for printing was still too low, thus the examination may be repeated with a higher level of the energy for printing.

Next, the recording medium having been turned to the second color is heated by different temperature to examine the temperature level for shifting the medium to the first color. The recording medium may be heated by the use of a heat-gradient tester (HG-100, made by Toyo Seiki). The heat-gradient tester includes five heating blocks, they can be set to desired temperatures respectively and can also be adjusted in the duration of heating and the level of pressure. Accordingly, the recording medium can be heated by five different temperatures at once under the setting conditions. For example, under a pressure of about 2.5 kg/cm$^2$ during the heating, the recording medium is heated for one second by a range of the temperature varied at equal intervals of 1 to 5 degrees from a too low level which generates no change to a level which shifts the first color to the second color or holds the color unchanged. For inhibiting the sticking or adhesion of the medium to the heat blocks, the heat blocks are favorably protected with a thin film (of not thicker than 10 $\mu$m) of polyimide or polyamide. After heated up, the recording medium is cooled down to the normal temperature level and measured for the optical density using a reflection densitometer, Macbeth RD-914. Resultant measurement are plotted in a graphic diagram, shown in FIG. 2, where the horizontal axis represents the setting temperature of the heat-gradient tester and the vertical axis represents the reflection density. When the recording medium includes a transparent supporting substrate, a sheet thereto light is either absorbed or reflected is inserted at the back of the transparent supporting substrate during the measurement of the density. As a series of measurements of the density with corresponding temperatures are marked with dots and joined one after another by lines to complete a curve profile. The profile is commonly configured in a trapezoid form as shown in FIGS. 3 and 4.

According to the present invention, a lubricant having melting point ranges from the first specific temperature level to the second specific temperature may be included in a protective layer of the reversible thermosensitive recording medium. It realizes a high lubricating properties of the surface heated at an elevated temperature, thus improving the thermal matching. Also, only when the reversiblethermosensitive recording medium is highly heated up for the erasing process, the lubricant melts down to a liquid form to fill and eliminate the gap of air formed between the surface of the reversible thermosensitive recording medium and the heating head, hence contributing to the uniform application of energy and the improvement of the erasing performance of the head. Moreover, the lubricant remains in its solid form at the normal temperature, thus eliminating unfavorable side effects including blocking and adhesion of dirt on the reversible thermosensitive recording medium which will decline the storage durability by an ooze out of the lubricant to the surface which will infects the secondary processing quality such as ease of printing.

The reversible thermosensitive recording medium of the present invention can highly be improved in the storage and second processing properties when the melting point of the lubricant is close to the second specific temperature level $T_2$. The difference is preferably smaller than the second specific temperature level minus 20° C. and more preferably the second specific temperature minus 10° C.

The lubricant contained in the protective layer according to the present invention has characteristics that having an appropriate melting point, remaining in a solid state at the normal temperature, and becoming lubricant when melted down and may be selected from, but not limited to, aliphatic hydrocarbon lubricants, higher aliphatic alcohol, higher aliphatic acid lubricants, aliphatic acid amaide lubricants, metallic soap lubricants, and aliphatic acid ester lubricants. Those lubricant never interrupts the visibility of images developed on the reversible thermosensitive recording medium of the present invention. The lubricant may be one kind of material or a mixture of two or more thereby. When two or more materials are used, their different melting points can provide individual separated functions which may effect during the printing and erasing actions on the reversible thermosensitive recording medium, hence ensuring more explicit grades of the effect.

The diameter of the particles of the lubricant in the protective layer according to the present invention may be measured by a transmission electron microscope (TEM) inspecting the cross section of the layer. The TEM cross section measurement is carried out where the reversible thermosensitive recording medium is exposed to a vapor of osmium acid for twelve hours to dye the resin material, solidified with a two-liquid curable epoxy resin (made by Sony Chemical), sliced into pieces of 1000 to 13000 angstroms thick by a micro-tone (MT6000-XL, made by RMC), and pictured at the cross section by a TEM (H-500H, made by Hitachi). The particle diameter per unit area is finally measured.

The content of the organic monomeric material per unit weight in each may be calculated by scraping off the layer, and weighing its scraped layer, immersing the medium for 24 hours in a solvent which can dissolve only the lubricant, and weighing the remaining. Also, the content may be calculated from the ratio of area per unit and the specific weight of the resin and the organic monomeric material.

The diameter of the particles of the lubricant contained in the protective layer is preferably smaller than the thickness of the protective layer, more preferably smaller than ⅔ the thickness of the protective layer, and most preferably smaller than ½ the thickness of the protective layer. If the diameter is not smaller than the thickness of the protective layer, the resin in the protective layer will hardly be solidly but porous, thus declining the mechanical strength. In addition, the lubricant may remain exposed at the surface of the protective layer hence infecting the secondary processing properties for printing.

The content (%) of the lubricant contained in the protective layer is preferably equal to or higher than 0.1 and lower than 10.0 and more preferably ranges from 0.5 to 5.0. If the content is too little, the effect of filling the gap of air will be declined. If too much, the lubricant may appear at the surface of the layer and interrupt the ease of printing. A redundancy of the lubricant may also remain as head soils hence allowing no uniformity of the recording and erasing of images. Also, when the lubricant is heated up during the printing and erasing action of the thermosensitive recording medium, it will melt down and cause the protective layer to be porous resulting in declination in the mechanical strength.

The curable resin being bridged in the recording layer and in the intermediate layer and for use in the protective layer according to the present invention is a bridging agent or a combination of the bridging agent and a resin having an active group or groups which are reactive with the bridging agent. The curable resin can be cured and bridged by application of heat. Characteristic examples of the curable resin are a resin having hydroxy group or groups, carboxy group or groups, those all are reactive with the bridging agent. They are instanced as phenoxy resin, polyvinyl butyral resin, cellulose acetate propionate or cellulose acetate butyrate, and a copolymer resin obtained from copolymerization of a resin having hydroxy or carboxy group or groups reactive with the bridging agent and any other resin. The copolymer resin may include vinyl chloride resin type, acryl resin type, and styrene resin type. To be more tangible, vinyl chloride/vinyl acetate/vinyl alcohol copolymer, vinyl chloride/hydroxy propyl acrylate copolymer, and vinyl chloride/vinyl acetate/maleic anhydride copolymer are instanced.

The bridging agent for heat bridging may include isocyanates, amino resins, phenol resins, amines, and epoxy compounds. For example, the isocyanates include a polyisocyanate compound having a plural of isocyanate groups, such as hexamethyl-diisocyanate (HDI), toluene-diisocyanate (TDI), xylylene-diisocyanate (XDI) and the like, and their adduct form, bullet form, isocyanurate form, or block isocyanate form which are formed by use of trimethlolpropane or the like. The dope of the bridging agent for the resin, by the ratio of functional groups in the bridging agent to the number of active groups in the resin, is preferably 0.01 to 2. If lower, the thermal strength will be declined. When higher, the coloring and de-coloring performance will be infected. Alternatively, a bridging accelerator may be used in the form of a catalyst. Characteristic examples of the bridging accelerator include tertiary amine such as 1,4-diaza-bicylo[2,2,2]-octane and metallic compound such as organic tin compound.

The bridging agent for curing with use of electron beam or ultraviolet ray may include urethane acrylate type, epoxy acrylate type, polyester acrylate type, polyether acrylate type, vinyl type, unsaturated polyester type of oligomers, and monomers of mono- or poly-functional-acrylates, or -methacrylates, vinyl esters, styrene derivatives, and aryl compounds. Characteristic examples of the non functional monomer are: (1) methyl methacrylate (MMA), (2) ethyl methacrylate (EMA), (3) n-butyl methacrylate (BMA), (4) isobutyl methacrylate (IBMA), (5) t-butyl methacrylate (TBMA), (6) 2-ethyl hexyl methacrylate (EHMA), (7) lauryl methacrylate (LMA), (8) s-lauryl methacrylate (SLMA), (9) tri-decyl methacrylate (TDMA), (10) stearyl methacrylate (SMA), (11) cyclohexyl methacrylate (CHMA), and (12) benzyl methacrylate (BZMA).

Characteristic examples of the mono-functional monomer include: (13) methacrylic acid (MAA), (14) 2-hydroxyethyl methacrylate (HEMA), (15) 2-hydroxypropyl methacrylate (HPMA), (16) dimethylaminoethyl methacrylate (DMMA), (17) dimethylaminoethyl chloride methacrylate (DMCMA), (18) diethylanimoethyl methacrylate (DEMA), (19) glycydyl methacrylate (GMA), (20) tetra-hydrofurfuryl methacrylate (THFMA), (21) aryl methacrylate (AMA), (22) ethylene glycol dimethacrylate (EDMA), (23) tri-ethylene glycol dimethacrylate (3EDMA), (24) tetra-ethylene glycol dimethacrylate (4EDMA), (25) 1,3-butylene glycol dimethacrylate (BDMA), (26) 1,6-hexanediol dimethacrylate (HXMA), (27) tri-methylpropane trimethacrylate (TMPMA), (28) 2-ethoxyethyl methacrylate (29) 2-ethylhexyl acrylate (30) phenoxyethyl acrylate, (31) 2-ethoxyethyl acrylate, (32) 2-ethoxy-ethoxyethyl acrylate, (33) 2-hydoxypropyl acrylate, (34) 2-hydroxypropyl acrylate, (35) dicyclopentenil-oxyethyl acrylate, (36) N-vinyl prorydone, and (37) vinyl acetate.

Characteristic examples of the bifunctional monomer include: (38) 1,4-butanediol acrylate, (39) 1,6-hexanediol, diacrylate, (40) 1,9-nonanediol diacrylate, (41) neo-pentyl glycol diacrylate, (42) tetra-ethylene glycol diacrylate, (43) tri-propylene glycol diacrylate, (44) tri-propylene glycol diacrylate, (45) polypropylene glycol diacrylate, (46) bisphenol A.EO adduct diacryalte, (47) glycerin methacrylate acrylate, (48) (neo-pentyl glycol)propylene oxide 2-mol adduct diacrylate, (49) diethylene glycol diacrylate, (50) polyethylene glycol (400) diacrylate, (51) (hydroxypivalylic acid and neo-pentyl glycol)ester diacrylate (52) 2,2-bis(4-acryloxy diethoxyphenil) propane, (53) (neo-pentyl glycol adipate)diacrylate, (54) (hydroxypivalylic neo-pentyl glycol) ϵ-caprolactone adduct diacrylate, (55) (hydroxypivalylic neo-pentyl glycol) ϵ-caprolactone adduct diacrylate, (56) 2-(2-hydroxy-1,1-dimethyethyl)-5-hydroxymethyl-5-ethyl-1,3-dioxythane diacrylate, (57) tricyclodecane-dimethylol diacrylate, (58) (tri-cyclodecane-dimethyl diacrylate) ϵ-caprolactone adduct, and (59) 1,6-hexanediol diglycylether diacrylate.

Characteristic examples of the poly-functional monomer include: (60) tri-methylpropane triacrylate, (61) penta-erythritol triacrylate, (62) glycerin PO adduct triacrylate, (63) tri-acryloil-oxyethyle phosphate, (64) penta-erythritol tetraacrylate, (65) (trimethylol propane)propylene oxide 3-mol adduct triacrylate, (66) glycelylpropoxy triacrylate, (67) dipenta-erythritol polyacrylate, (68) (dipenta-erythritol) caprolactane adduct polyacrylate, (69) propionic dipenta-erythritol tiractylate, (70) hydroxypival aldehyde denatured dimethylolpropyne triacrylate, (71) propionic dipenta-erythritol tetraacrylate, (72) ditri-methylorlpropane tetraacrylate, (73) propionic dipenta-erythritol pentaacrylate, (74) dipenta-erythritol hexaacrylate (DPHA), and (75) DPHA ϵ-caprolactone adduct.

A characteristic example of the oligomer includes (76) bis-phenol A-diepoxyacrylic acid adduct.

Those bridging agents may be used as single or mixture thereof. The content of the bridging agent(s) in the barrier layer is preferably 5 to 50% by weight and more preferably 10 to 40% by weight. If the content is lower than 5% by weight, the bridging effect will be declined. When higher than 50% by weight, the erasing properties on the thermosensitive layer will be declined. As understood from the descriptions above, for improving the bridging effect with a minimum amount of the additive, it is desired that as for the bridging agent is favorable a functional monomer rather than a non-functional monomer and more preferably a poly-functional monomer rather than a mono-functional monomer.

The photo polymerizing initiator used in accordance to the present invention is classified into a radical reactive type and an ion reactive type. The radical reactive type is classed into a photo-cleavage type and a de-hydrogenation type. Characteristic examples of the photo polymerizing initiator are, but not limited to: (1). benzoin ether, isobutyl benzoin ether, isopropyl benzoin ether, benzoin methylether, (2). α-acyloxime ester, 1-phenil-1,2-propanedion-2-(o-ethoxycarbonil)-oxime, (3). Benzylketal, 2,2-dimethoxy-2-phenylacetophenonebenzyl, hydroxycyclohexylphenyl ketone, (4). Acetophenone derivative, diethoxyacetophenone, 2-hydroxy-2-methyl-1-phenylpropane-1-one, (5). ketone-(ketone-amine), benzophenone, chlorothioxanthon, 2-chlorothioxanthon, isopropylthioxanthon, 2-methylthioxanthon, chlorine substituted benzophenone.

Those photo polymerizing initiators may be used as single or mixture thereof by desired. The content of the photo polymerizing initiator(s) is preferably 0.005 to 1.0 part by weight and more preferably 0.01 to 0.5 part by weight for 1 part of the bridging agent.

The photo polymerizing accelerator used in accordance to the present invention has an effect of improving the speed of curing, unlike the photo polymerizing initiator of de-hydrogenation type such as benzophenone or thioxanthon, and may include aromatic tertiary amine or aliphatic amine. Characteristic examples of the photo-polymerizing accelerator are p-dimethylamino benzoate isoamylester and p-dimethylamino bennzoate ethylester. The photo polymerizing accelerators may be used as single or mixture thereof by desired. The content of the photo-polymerizing accelerator is preferably 0.1 to 5 parts by weight and more preferably 0.3 to 3 parts by weight for 1 part of the photo polymerizing initiator.

The developer used in combination with the colorant in the reversible thermosensitive recording medium of the present invention will now be described. As disclosed on Japanese Unxamined Patent Publication of Tokkai Hei 5-14360 where phosphor compounds, fatty acid compounds, and phenol compounds, those all have long chain hydrocarbon group or groups, are listed as the developer may be used, wherein the developer comprises a compound in which there are provided a color developing configuration part for activating the colorant and an aggregation-controlling configuration part for controlling the aggregation of inter molecule. The developing composition, like a common thermosensitive recording medium, may conclude, but not limited to, phenollic hydroxy group, carboxyl group, phosphate group, and other acidity group or groups whereby the colorant is favorably activated. Characteristic examples of such acidity group or groups are thiourea group and metal carboxylate group. The typical configuration part for controlling the aggregation of molecules may be a hydrocarbon group such as long chain alkyl group. The number of carbons in each hydrocarbon is preferably more than or equal to eight for yielding a desired level of the coloring and de-coloring properties. Also, the hydrocarbon may conclude an unsaturated bond form or in a branch bond form. Similarly, the number of carbons in the main chained portion is preferably more than or equal to eight. The hydrocarbon may be substituted by halogen atoms, a hydroxyl group, or a alcoholic group.

The developer has the configuration parts for developing color and the composition, such as hydrocarbon group, and for controlling the aggregation, both parts are bonded each other in the molecule. The both parts may be bonded through a divalent group or groups containing hetero atom or atoms or by aromatic ring such as phenylene or naphthylene or a heterocyclic ring or both. The hydrocarbon may include divalent group or groups in a chain structure having aromatic ring or rings and hetero atom or atoms. The developer according to the present invention may be selected from the following compounds.

Characteristic examples of the developer of organic phosphate type are: dodecyl phosphonic acid, tetradodecyl phosphonic acid, hexadodecyl phosphonic acid, octadodecyl phosphonic acid, eicocyl phosphonic acid, dococyl phosphonic acid, tetracocyl phosphonic acid, dodecyl phosphonic acid, phosphate ditetradecylester, phosphate dihexadecylester, phosphate dioctadecylester, phosphate dieicocylester, and phosphate dibehenylester.

Characteristic examples of the developer of aliphatic carboxy compound are: 2-hydroxytetradecanoic acid, 2-hydroxyhexadecanoic acid, 2-hydroxyoctadecanoic acid, 2-hydroxyeicosanoic acid, 2-hydroxydocosanoic acid, 2-bromooctadecanoic acid, 2-bromoeicosanoic acid, 2-bromodocosanoic acid, 3-bromooctadecanoic acid, 3-bromodocosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocodanoic acid, 2-iodohexadecanoic acid, 2-iodooctadecanoic acid, 3-iodohexadecanoic acid, 3-iodooctadecanoic acid, and perfluorooctadecanoic acid.

Characteristic examples of the developer of aliphatic dicarboxy and -tricarboxyl compound are: 2-dodecyloxysuccinic acid, 2-tetradecyloxysuccinic acid, 2-hexadecyloxysuccinic acid, 2-octadecyloxysuccinic acid, 2-eicocyloxysuccinic acid, 2-dodecyloxysuccinic acid, 2-dodecylthiosuccinic acid, 2-tetradecylthiosuccinic acid, 2-hexadecylthiosuccinic acid, 2-octadecylthiosuccinic acid, 2-eicocylthiosuccinic acid, 2-docoylthiosuccinic acid, 2-tetracocylthiosuccinic acid, 2-hexadecylthiosuccinic acid, 2-octadecylthiosuccinic acid, 2-eicocyldithiosuccinic acid, dodecylsuccinic acid, tetradecylsuccinic acid, pentadecylsuccinic acid, hexadecylsuccinic acid, octadecylsuccinic acid, eicocylsuccinic acid, dococylsuccinic acid, 2,3-dihexadecylsuccinic acid, 2,3-dioctyldecylsuccinic acid, 2-methyl-3-hexadecylsuccinic acid, 2-methyl-3-octadecylsuccinic acid, 2-octadecyl-3-hexadeylsuccinic acid, hexadecylmalonic acid, octadecylmalonic acid, eicocylmalonic acid, dococylmalonic acid, dihexadecylmalonic acid, dioctadecylmalonic acid, didococylmalonic acid, methyloctadecylmalonic acid, 2-hexadecylglutaric acid, 2-octadecylglutanic acid, 2-eicocylglutaric acid, dococylglutaric acid, 2-pentadecyladipic acid, 2-octadecyladipic acid, 2-eicocyladipic acid, 2-dococyladipic acid, 2-hexadecanoiloxypropane-1,2,3-tricarbonic acid, and 2-octadecanoiloxypropane-1,2,3-tricarbonic acid.

The carboxylic compound may be represented by Formula (1),

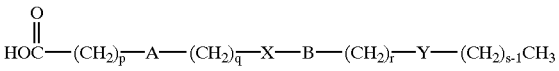

(1)

Characteristic examples of the carboxylic compound represented by Formula (1) are listed below in Tables 1 to 6 using the symbols p, q, r, s, A, B, X, and Y.

TABLE 1

| p | A | q | X | B | r | Y | s |
|---|---|---|---|---|---|---|---|
| 0 | — | 0 | CO | — | 0 | — | 12 |
| 0 | — | 0 | CO | — | 0 | — | 16 |
| 0 | — | 0 | CO | — | 0 | — | 18 |
| 1 | — | 0 | CO | — | 0 | — | 14 |
| 1 | — | 0 | CO | — | 0 | — | 18 |
| 1 | — | 0 | CO | — | 0 | — | 22 |
| 2 | — | 0 | CO | — | 0 | — | 16 |
| 1 | — | 0 | $SO_2$ | — | 0 | — | 14 |
| 2 | — | 0 | $SO_2$ | — | 0 | — | 18 |
| 2 | — | 0 | $SO_2$ | — | 0 | — | 20 |
| 4 | — | 0 | $SO_2$ | — | 0 | — | 18 |
| 5 | — | 0 | $SO_2$ | — | 0 | — | 11 |
| 6 | — | 0 | $SO_2$ | — | 0 | — | 18 |
| 3 | — | 0 | $SO_2$ | — | 4 | S | 12 |
| 2 | — | 0 | $SO_2$ | p-phenylene | 0 | S | 18 |
| 1 | — | 0 | $SO_2$ | — | 3 | $SO_2$ | 16 |
| 4 | — | 0 | $SO_2$ | — | 10 | CONH | 6 |
| 2 | — | 0 | $SO_2$ | p-phenylene | 0 | CONH | 18 |
| 3 | — | 0 | $SO_2$ | — | 3 | $SO_2NH$ | 16 |
| 1 | — | 0 | $SO_2$ | — | 6 | OCO | 10 |
| 4 | — | 0 | $SO_2$ | — | 10 | NHCO | 14 |
| 2 | — | 0 | $SO_2$ | — | 2 | $NHSO_2$ | 18 |
| 2 | — | 0 | $SO_2$ | — | 6 | NHCONH | 14 |
| 2 | — | 0 | $SO_2$ | p-phenylene | 0 | NHCONH | 18 |
| 2 | — | 0 | $SO_2$ | — | 3 | NHCOO | 16 |
| 2 | — | 0 | $SO_2$ | p-phenylene | 0 | OCONH | 18 |
| 4 | — | 0 | $SO_2$ | — | 2 | CONHCO | 16 |
| 2 | — | 0 | $SO_2$ | — | 12 | NHCONHCO | 8 |
| 3 | — | 0 | $SO_2$ | — | 6 | CONHNHCO | 16 |
| 4 | — | 0 | $SO_2$ | — | 4 | CONHCONH | 14 |
| 5 | — | 0 | $SO_2$ | — | 10 | NHCONHNH | 10 |
| 2 | — | 0 | $SO_2$ | — | 2 | NHNHCONH | 18 |
| 3 | — | 0 | $SO_2$ | — | 6 | NHCOCONH | 20 |
| 4 | — | 0 | $SO_2$ | — | 6 | NHCONHNHCO | 18 |
| 2 | — | 0 | $SO_2$ | p-phenylene | 8 | CONHNHCOO | 18 |
| 2 | — | 0 | $SO_2$ | — | 4 | CONHNHCONH | 18 |

TABLE 2

| p | A | q | X | B | r | Y | s |
|---|---|---|---|---|---|---|---|
| 2 | — | 0 | S | — | 0 | — | 20 |
| 1 | — | 0 | S | — | 0 | — | 14 |
| 2 | — | 0 | S | — | 0 | — | 16 |
| 2 | — | 0 | S | — | 0 | — | 18 |
| 3 | — | 0 | S | — | 0 | — | 22 |
| 3 | — | 0 | S | — | 4 | S | 12 |
| 2 | — | 0 | S | p-phenylene | 0 | S | 18 |
| 1 | — | 0 | S | — | 3 | $SO_2$ | 16 |
| 2 | — | 0 | S | — | 2 | CONH | 18 |
| 2 | — | 0 | S | p-phenylene | 0 | CONH | 18 |
| 3 | — | 0 | S | — | 3 | $SO_2NH$ | 16 |
| 2 | — | 0 | S | — | 1 | NHCO | 18 |
| 2 | — | 0 | S | — | 2 | $NHSO_2$ | 18 |
| 3 | — | 0 | S | — | 12 | NHCONH | 8 |
| 2 | — | 0 | S | p-phenylene | 0 | NHCONH | 18 |
| 2 | — | 0 | S | — | 3 | NHCOO | 16 |
| 2 | — | 0 | S | p-phenylene | 0 | OCONH | 18 |
| 4 | — | 0 | S | — | 2 | CONHCO | 16 |
| 2 | — | 0 | S | — | 4 | NHCONHNH | 18 |
| 3 | — | 0 | S | — | 6 | CONHNHCO | 16 |
| 4 | — | 0 | S | — | 4 | CONHCONH | 14 |
| 2 | — | 0 | S | — | 2 | NHNHCONH | 18 |
| 3 | — | 0 | S | — | 6 | NHCOCONH | 20 |
| 4 | — | 0 | S | — | 6 | NHCONHNHCO | 18 |
| 2 | — | 0 | S | — | 4 | CONHNHCONH | 18 |

TABLE 3

| p | A | q | X | B | r | Y | s |
|---|---|---|---|---|---|---|---|
| 2 | — | 0 | NHCO | — | 0 | — | 20 |
| 1 | — | 0 | NHCO | — | 0 | — | 12 |

TABLE 3-continued

| p | A | q | X | B | r | Y | s |
|---|---|---|---|---|---|---|---|
| 2 | — | 0 | NHCO | — | 0 | — | 18 |
| 3 | — | 0 | NHCO | — | 0 | — | 22 |
| 4 | — | 0 | NHCO | — | 0 | — | 18 |
| 3 | — | 0 | NHCO | — | 4 | S | 12 |
| 2 | — | 0 | NHCO | p-phenylene | 0 | S | 18 |
| 1 | — | 0 | NHCO | — | 3 | $SO_2$ | 16 |
| 2 | — | 0 | NHCO | — | 2 | CONH | 18 |
| 3 | — | 0 | NHCO | — | 3 | $SO_2NH$ | 16 |
| 4 | — | 0 | NHCO | — | 3 | SCO | 16 |
| 4 | — | 0 | NHCO | — | 10 | NHCO | 14 |
| 4 | — | 0 | NHCO | — | 6 | N=CH | 16 |
| 2 | — | 0 | NHCO | — | 6 | NHCONH | 14 |
| 2 | — | 0 | NHCO | p-phenylene | 0 | NHCONH | 18 |
| 4 | — | 0 | NHCO | — | 4 | OCONH | 18 |
| 2 | — | 0 | NHCO | p-phenylene | 0 | OCONH | 18 |
| 3 | — | 0 | NHCO | — | 6 | NHCSO | 18 |
| 2 | — | 0 | NHCO | — | 12 | NHCONHCO | 8 |
| 3 | — | 0 | NHCO | — | 6 | CONHNHCO | 16 |
| 4 | — | 0 | NHCO | — | 4 | CONHCONH | 14 |
| 5 | — | 0 | NHCO | — | 10 | NHCONHNH | 10 |
| 3 | — | 0 | NHCO | — | 6 | NHCOCONH | 20 |
| 2 | — | 0 | NHCO | p-phenylene | 8 | CONHNHCOO | 18 |

TABLE 4

| p | A | q | X | B | r | Y | s |
|---|---|---|---|---|---|---|---|
| 1 | — | 0 | CONH | — | 0 | — | 12 |
| 2 | — | 0 | CONH | — | 0 | — | 16 |
| 2 | — | 0 | CONH | — | 0 | — | 18 |
| 3 | — | 0 | CONH | — | 0 | — | 22 |
| 5 | — | 0 | CONH | — | 0 | — | 11 |
| 2 | — | 0 | CONH | p-phenylene | 0 | S | 18 |
| 1 | — | 0 | CONH | — | 3 | $SO_2$ | 16 |
| 2 | — | 0 | CONH | — | 2 | CONH | 18 |
| 2 | — | 0 | CONH | p-phenylene | 0 | CONH | 18 |
| 4 | — | 0 | CONH | — | 3 | SCO | 16 |
| 1 | — | 0 | CONH | — | 6 | OCO | 10 |
| 4 | — | 0 | CONH | — | 10 | NHCO | 14 |
| 2 | — | 0 | CONH | — | 4 | COO | 22 |
| 2 | — | 0 | CONH | — | 2 | $NHSO_2$ | 18 |
| 3 | — | 0 | CONH | — | 12 | NHCONH | 8 |
| 2 | — | 0 | CONH | p-phenylene | 0 | NHCONH | 18 |
| 5 | — | 0 | CONH | — | 2 | NHSONH | 20 |
| 2 | — | 0 | CONH | — | 3 | NHCOO | 16 |
| 4 | — | 0 | CONH | — | 4 | OCONH | 18 |
| 2 | — | 0 | CONH | p-phenylene | 0 | OCONH | 18 |
| 3 | — | 0 | CONH | — | 6 | NHCSO | 18 |
| 4 | — | 0 | CONH | — | 2 | CONHCO | 16 |
| 2 | — | 0 | CONH | — | 12 | NHCONHCO | 8 |
| 3 | — | 0 | CONH | — | 6 | CONHNHCO | 16 |
| 4 | — | 0 | CONH | — | 4 | CONHCONH | 14 |
| 2 | — | 0 | CONH | — | 2 | NHNHCONH | 18 |
| 3 | — | 0 | CONH | — | 6 | NHCOCONH | 20 |
| 4 | — | 0 | CONH | — | 6 | NHCONHNHCO | 18 |
| 2 | — | 0 | CONH | p-phenylene | 8 | CONHNHCOO | 18 |

TABLE 5

| p | A | q | X | B | r | Y | s |
|---|---|---|---|---|---|---|---|
| 2 | — | 0 | NHCONH | — | 0 | — | 20 |
| 2 | — | 0 | NHCONH | — | 0 | — | 16 |
| 2 | — | 0 | NHCONH | — | 0 | — | 18 |
| 3 | — | 0 | NHCONH | — | 0 | — | 22 |
| 4 | — | 0 | NHCONH | — | 0 | — | 18 |
| 3 | — | 0 | NHCONH | — | 4 | S | 12 |
| 2 | — | 0 | NHCONH | p-phenylene | 0 | S | 18 |
| 1 | — | 0 | NHCONH | — | 3 | $SO_2$ | 16 |
| 4 | — | 0 | NHCONH | — | 10 | CONH | 6 |
| 2 | — | 0 | NHCONH | p-phenylene | 0 | CONH | 18 |
| 3 | — | 0 | NHCONH | — | 3 | $SO_2NH$ | 16 |

TABLE 5-continued

| p | A | q | X | B | r | Y | s |
|---|---|---|---|---|---|---|---|
| 4 | — | 0 | NHCONH | — | 3 | SCO | 16 |
| 4 | — | 0 | NHCONH | — | 10 | NHCO | 14 |
| 3 | — | 0 | NHCONH | — | 12 | COS | 6 |
| 2 | — | 0 | NHCONH | — | 4 | COO | 22 |
| 2 | — | 0 | NHCONH | — | 6 | NHCONH | 14 |
| 2 | — | 0 | NHCONH | p-phenylene | 0 | NHCONH | 18 |
| 5 | — | 0 | NHCONH | — | 2 | NHSONH | 20 |
| 2 | — | 0 | NHCONH | — | 3 | NHCOO | 16 |
| 2 | — | 0 | NHCONH | p-phenylene | 0 | OCONH | 18 |
| 1 | — | 0 | NHCONH | — | 3 | NHCOO | 14 |
| 3 | — | 0 | NHCONH | — | 6 | NHCSO | 18 |
| 2 | — | 0 | NHCONH | — | 12 | NHCONHCO | 8 |
| 2 | — | 0 | NHCONH | — | 4 | NHCONHNH | 18 |
| 3 | — | 0 | NHCONH | — | 6 | CONHNHCO | 16 |
| 4 | — | 0 | NHCONH | — | 4 | CONHCONH | 14 |
| 5 | — | 0 | NHCONH | — | 10 | NHCONHNH | 10 |
| 2 | — | 0 | NHCONH | — | 2 | NHNHCONH | 18 |
| 3 | — | 0 | NHCONH | — | 6 | NHCOCONH | 20 |
| 2 | — | 0 | NHCONH | — | 4 | CONHNHCONH | 18 |

TABLE 6

| p | A | q | X | B | r | Y | s |
|---|---|---|---|---|---|---|---|
| 1 | p-phenylene | 0 | NHCONH | — | 0 | — | 18 |
| 1 | p-phenylene | 0 | NHCONH | — | 0 | — | 22 |
| 2 | p-phenylene | 0 | NHCONH | — | 0 | — | 16 |
| 3 | p-phenylene | 0 | NHCONH | — | 0 | — | 18 |
| 1 | p-phenylene | 1 | NHCONH | — | 0 | — | 18 |
| 1 | p-phenylene | 2 | NHCONH | — | 0 | — | 16 |
| 2 | p-phenylene | 1 | NHCONH | — | 0 | — | 20 |
| 1 | p-phenylene | 0 | NHCONH | — | 6 | O | 16 |
| 1 | p-phenylene | 1 | NHCONH | — | 2 | O | 18 |
| 2 | p-phenylene | 0 | NHCONH | — | 8 | O | 14 |
| 2 | p-phenylene | 0 | NHCONH | p-phenylene | 0 | O | 18 |
| 1 | p-phenylene | 0 | NHCONH | p-phenylene | 0 | OCO | 20 |
| 1 | p-phenylene | 2 | NHCONH | p-phenylene | 0 | CO | 18 |
| 1 | p-phenylene | 0 | NHCONH | p-phenylene | 0 | S | 22 |
| 2 | p-phenylene | 0 | NHCONH | p-phenylene | 0 | NHCO | 16 |
| 1 | p-phenylene | 0 | NHCONH | p-phenylene | 0 | CONH | 18 |
| 1 | p-phenylene | 1 | NHCONH | p-phenylene | 0 | NHCONH | 18 |
| 1 | p-phenylene | 0 | NHCONH | p-phenylene | 0 | COO | 20 |
| 2 | p-phenylene | 0 | NHCONH | p-phenylene | 0 | $SO_2$ | 14 |
| 1 | p-phenylene | 0 | NHCO | — | 0 | — | 18 |
| 1 | p-phenylene | 0 | NHCO | — | 0 | — | 22 |
| 2 | p-phenylene | 0 | NHCO | — | 0 | — | 16 |
| 3 | p-phenylene | 0 | NHCO | — | 0 | — | 18 |
| 1 | p-phenylene | 1 | NHCO | — | 0 | — | 18 |
| 1 | p-phenylene | 2 | NHCO | — | 0 | — | 16 |
| 2 | p-phenylene | 1 | NHCO | — | 0 | — | 20 |
| 1 | p-phenylene | 0 | NHCO | — | 6 | O | 16 |
| 1 | p-phenylene | 1 | NHCO | — | 2 | O | 18 |
| 2 | p-phenylene | 0 | NHCO | — | 8 | O | 14 |
| 2 | p-phenylene | 0 | NHCO | p-phenylene | 0 | O | 18 |
| 1 | p-phenylene | 0 | NHCO | p-phenylene | 0 | OCO | 20 |
| 1 | p-phenylene | 2 | NHCO | p-phenylene | 0 | CO | 18 |
| 1 | p-phenylene | 0 | NHCO | p-phenylene | 0 | S | 22 |
| 2 | p-phenylene | 0 | NHCO | p-phenylene | 0 | NHCO | 16 |
| 1 | p-phenylene | 0 | NHCO | p-phenylene | 0 | CONH | 18 |
| 1 | p-phenylene | 1 | NHCO | p-phenylene | 0 | NHCONH | 18 |
| 1 | p-phenylene | 0 | NHCO | p-phenylene | 0 | COO | 20 |
| 2 | p-phenylene | 0 | NHCO | p-phenylene | 0 | $SO_2$ | 14 |
| 1 | p-phenylene | 0 | CONH | — | 0 | — | 18 |
| 1 | p-phenylene | 0 | CONH | — | 0 | — | 22 |
| 2 | p-phenylene | 0 | CONH | — | 0 | — | 16 |
| 3 | p-phenylene | 0 | CONH | — | 0 | — | 18 |
| 1 | p-phenylene | 1 | CONH | — | 0 | — | 18 |
| 1 | p-phenylene | 2 | CONH | — | 0 | — | 16 |
| 2 | p-phenylene | 1 | CONH | — | 0 | — | 20 |
| 1 | p-phenylene | 0 | CONH | — | 6 | O | 16 |
| 1 | p-phenylene | 1 | CONH | — | 2 | O | 18 |
| 2 | p-phenylene | 0 | CONH | — | 8 | O | 14 |
| 2 | p-phenylene | 0 | CONH | p-phenylene | 0 | O | 18 |

TABLE 6-continued

| p | A | q | X | B | r | Y | s |
|---|---|---|---|---|---|---|---|
| 1 | p-phenylene | 0 | CONH | p-phenylene | 0 | OCO | 20 |
| 1 | p-phenylene | 2 | CONH | p-phenylene | 0 | CO | 18 |
| 1 | p-phenylene | 0 | CONH | p-phenylene | 0 | S | 22 |
| 2 | p-phenylene | 0 | CONH | p-phenylene | 0 | NHCO | 16 |
| 1 | p-phenylene | 0 | CONH | p-phenylene | 0 | CONH | 18 |
| 1 | p-phenylene | 1 | CONH | p-phenylene | 0 | NHCONH | 18 |
| 1 | p-phenylene | 0 | CONH | p-phenylene | 0 | COO | 20 |
| 2 | p-phenylene | 0 | CONH | p-phenylene | 0 | $SO_2$ | 14 |
| 1 | p-phenylene | 0 | OCONH | — | 0 | — | 18 |
| 2 | p-phenylene | 0 | OCONH | — | 0 | — | 16 |
| 3 | p-phenylene | 0 | OCONH | — | 0 | — | 18 |
| 1 | p-phenylene | 1 | OCONH | — | 0 | — | 18 |
| 1 | p-phenylene | 2 | OCONH | — | 0 | — | 16 |
| 2 | p-phenylene | 1 | OCONH | — | 0 | — | 20 |
| 1 | p-phenylene | 0 | OCONH | — | 6 | O | 16 |
| 1 | p-phenylene | 1 | OCONH | — | 2 | O | 18 |
| 2 | p-phenylene | 0 | OCONH | — | 8 | O | 14 |
| 2 | p-phenylene | 0 | OCONH | p-phenylene | 0 | O | 18 |
| 1 | p-phenylene | 0 | OCONH | p-phenylene | 0 | OCO | 20 |
| 1 | p-phenylene | 2 | OCONH | p-phenylene | 0 | CO | 18 |
| 1 | p-phenylene | 0 | OCONH | p-phenylene | 0 | S | 22 |
| 2 | p-phenylene | 0 | OCONH | p-phenylene | 0 | NHCO | 16 |
| 1 | p-phenylene | 0 | OCONH | p-phenylene | 0 | CONH | 18 |
| 1 | p-phenylene | 1 | OCONH | p-phenylene | 0 | NHCONH | 18 |
| 1 | p-phenylene | 0 | OCONH | p-phenylene | 0 | COO | 20 |
| 2 | p-phenylene | 0 | OCONH | p-phenylene | 0 | $SO_2$ | 14 |
| 1 | p-phenylene | 0 | COO | — | 0 | — | 18 |
| 2 | p-phenylene | 0 | OCO | — | 0 | — | 16 |
| 3 | p-phenylene | 0 | COO | — | 0 | — | 18 |
| 1 | p-phenylene | 1 | OCO | — | 0 | — | 18 |
| 1 | p-phenylene | 2 | COO | — | 0 | — | 16 |
| 2 | p-phenylene | 1 | OCO | — | 0 | — | 20 |
| 1 | p-phenylene | 0 | COO | — | 6 | O | 16 |
| 1 | p-phenylene | 1 | OCO | — | 2 | O | 18 |
| 2 | p-phenylene | 0 | COO | — | 8 | O | 14 |
| 2 | p-phenylene | 0 | OCO | p-phenylene | 0 | O | 18 |
| 1 | p-phenylene | 0 | OCO | p-phenylene | 0 | OCO | 20 |
| 1 | p-phenylene | 2 | COO | p-phenylene | 0 | CO | 18 |
| 1 | p-phenylene | 0 | OCO | p-phenylene | 0 | S | 22 |
| 2 | p-phenylene | 0 | COO | p-phenylene | 0 | NHCO | 16 |
| 1 | p-phenylene | 0 | COO | p-phenylene | 0 | CONH | 18 |
| 1 | p-phenylene | 1 | OCO | p-phenylene | 0 | NHCONH | 18 |
| 1 | p-phenylene | 0 | COO | p-phenylene | 0 | COO | 20 |
| 2 | p-phenylene | 0 | OCO | p-phenylene | 0 | $SO_2$ | 14 |
| 1 | p-phenylene | 0 | O | — | 0 | — | 14 |
| 1 | p-phenylene | 0 | S | — | 0 | — | 18 |
| 1 | p-phenylene | 0 | $SO_2$ | — | 0 | — | 22 |
| 2 | p-phenylene | 0 | O | — | 0 | — | 16 |
| 3 | p-phenylene | 0 | S | — | 0 | — | 18 |
| 1 | p-phenylene | 1 | $SO_2$ | — | 0 | — | 18 |
| 1 | p-phenylene | 2 | O | — | 0 | — | 16 |
| 2 | p-phenylene | 1 | S | — | 0 | — | 20 |
| 1 | p-phenylene | 0 | $SO_2$ | — | 6 | O | 16 |
| 1 | p-phenylene | 1 | O | — | 2 | O | 18 |
| 2 | p-phenylene | 0 | S | — | 8 | O | 14 |
| 2 | p-phenylene | 0 | $SO_2$ | p-phenylene | 0 | O | 18 |
| 1 | p-phenylene | 0 | O | p-phenylene | 0 | OCO | 20 |
| 1 | p-phenylene | 2 | S | p-phenylene | 0 | CO | 18 |
| 1 | p-phenylene | 0 | $SO_2$ | p-phenylene | 0 | S | 22 |
| 2 | p-phenylene | 0 | O | p-phenylene | 0 | NHCO | 16 |
| 1 | p-phenylene | 0 | S | p-phenylene | 0 | CONH | 18 |
| 1 | p-phenylene | 1 | O | p-phenylene | 0 | NHCONH | 18 |
| 1 | p-phenylene | 0 | $SO_2$ | p-phenylene | 0 | COO | 20 |
| 2 | p-phenylene | 0 | $SO_2$ | p-phenylene | 0 | $SO_2$ | 14 |

The carboxylic compound for the developer may be represented by Formula (2)

(2)

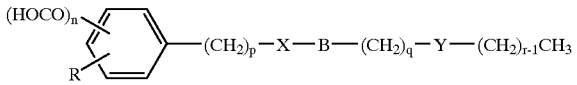

Characteristic examples of the carboxylic compound represented by Formula (2) are listed below in Table 7 using the symbols n, p, q, r, R, X, and Y.

TABLE 7

| n | R | p | X | B | q | Y | r |
|---|---|---|---|---|---|---|---|
| 1(4-) | — | 0 | NHCONH | — | 0 | — | 18 |
| 1(4-) | — | 1 | NHCONH | — | 0 | — | 20 |
| 2(3-,5-) | — | 0 | NHCONH | — | 0 | — | 14 |
| 2(4-) | (3-OH) | 0 | NHCONH | — | 0 | — | 18 |
| 1(4-) | (2-$CH_3$) | 0 | NHCONH | — | 0 | — | 16 |
| 1(4-) | (3-Cl) | 2 | NHCONH | — | 0 | — | 18 |
| 1(3-) | (4-OH) | 0 | NHCONH | — | 0 | — | 22 |
| 1(4-) | (3-OH) | 0 | NHCONH | — | 6 | O | 14 |
| 1(4-) | (3-OH) | 1 | NHCONH | p-phenylene | 0 | O | 18 |
| 1(4-) | (3-Cl) | 0 | NHCONH | p-phenylene | 0 | S | 16 |
| 1(3-) | (4-OH) | 0 | NHCONH | p-phenylene | 0 | NHCO | 18 |
| 1(3-) | (4-OH) | 0 | NHCONH | p-phenylene | 0 | CONH | 20 |
| 1(4-) | (3-OH) | 0 | NHCONH | p-phenylene | 0 | NHCONH | 18 |
| 1(4-) | (3-$OCH_3$) | 1 | NHCONH | p-phenylene | 0 | OCO | 14 |
| 1(4-) | (3-OH) | 0 | NHCONH | p-phenylene | 0 | COO | 18 |
| 1(4-) | (3-Cl) | 0 | NHCONH | p-phenylene | 0 | $SO_2$ | 18 |
| 1(4-) | (3-OH) | 0 | NHCONH | p-phenylene | 0 | $SO_2NH$ | 18 |
| 1(4-) | — | 0 | NHCO | — | 0 | — | 18 |
| 1(4-) | — | 2 | NHCO | — | 0 | — | 20 |
| 2(3-,4-) | — | 0 | NHCO | — | 0 | — | 14 |
| 2(4-) | (3-OH) | 0 | NHCO | — | 0 | — | 18 |
| 1(4-) | (2-$CH_3$) | 0 | NHCO | — | 0 | — | 16 |
| 1(4-) | (3-Cl) | 2 | NHCO | — | 0 | — | 18 |
| 1(3-) | (4-OH) | 0 | NHCO | — | 0 | — | 22 |
| 1(4-) | (3-OH) | 0 | NHCO | — | 6 | O | 14 |
| 1(4-) | (3-OH) | 1 | NHCO | p-phenylene | 0 | O | 18 |
| 1(4-) | (3-Cl) | 0 | NHCO | p-phenylene | 0 | CO | 16 |
| 1(3-) | (4-OH) | 0 | NHCO | p-phenylene | 0 | NHCO | 18 |
| 1(3-) | (4-OH) | 0 | NHCO | p-phenylene | 0 | CONH | 20 |
| 1(4-) | (3-OH) | 0 | NHCO | p-phenylene | 0 | NHCONH | 18 |
| 1(4-) | (3-$OCH_3$) | 1 | NHCO | p-phenylene | 0 | OCO | 14 |
| 1(4-) | (3-OH) | 0 | NHCO | p-phenylene | 0 | COO | 18 |
| 1(4-) | (3-Cl) | 0 | NHCO | p-phenylene | 0 | $SO_2$ | 18 |
| 1(4-) | (3-OH) | 0 | NHCO | p-phenylene | 0 | $SO_2NH$ | 18 |
| 1(4-) | — | 0 | CONH | — | 0 | — | 18 |
| 1(4-) | — | 1 | CONH | — | 0 | — | 20 |
| 2(3-,5-) | — | 0 | CONH | — | 0 | — | 14 |
| 2(4-) | (3-OH) | 0 | CONH | — | 0 | — | 18 |
| 1(4-) | (2-$CH_3$) | 0 | CONH | — | 0 | — | 16 |
| 1(4-) | (3-Cl) | 2 | CONH | — | 0 | — | 18 |
| 1(3-) | (4-OH) | 0 | CONH | — | 0 | — | 22 |
| 1(4-) | (3-OH) | 0 | CONH | — | 6 | O | 14 |
| 1(4-) | (3-OH) | 1 | CONH | p-phenylene | 0 | O | 18 |
| 1(4-) | (3-Cl) | 0 | CONH | p-phenylene | 0 | S | 16 |
| 1(3-) | (4-OH) | 0 | CONH | p-phenylene | 0 | NHCO | 18 |
| 1(3-) | (4-OH) | 0 | CONH | p-phenylene | 0 | CONH | 20 |
| 1(4-) | (3-OH) | 0 | CONH | p-phenylene | 0 | NHCONH | 18 |
| 1(4-) | (3-$OCH_3$) | 1 | CONH | p-phenylene | 0 | OCO | 14 |
| 1(4-) | (3-OH) | 0 | CONH | p-phenylene | 0 | COO | 18 |
| 1(4-) | (3-Cl) | 0 | CONH | p-phenylene | 0 | $SO_2$ | 18 |
| 1(4-) | (3-OH) | 0 | CONH | p-phenylene | 0 | $SO_2NH$ | 18 |
| 1(4-) | — | 0 | OCONH | — | 0 | — | 18 |
| 1(4-) | — | 2 | NHCOO | — | 0 | — | 20 |
| 2(3-,5-) | — | 0 | OCONH | — | 0 | — | 14 |
| 2(4-) | (3-OH) | 0 | NHCOO | — | 0 | — | 18 |
| 1(4-) | (2-$CH_3$) | 0 | OCONH | — | 0 | — | 16 |
| 1(4-) | (3-Cl) | 2 | NHCOO | — | 0 | — | 18 |
| 1(3-) | (4-OH) | 0 | OCONH | — | 0 | — | 22 |
| 1(4-) | (3-OH) | 0 | NHCOO | — | 6 | O | 14 |
| 1(4-) | (3-OH) | 1 | OCONH | p-phenylene | 0 | O | 18 |
| 1(4-) | (3-Cl) | 0 | NHCOO | p-phenylene | 0 | CO | 16 |
| 1(3-) | (4-OH) | 0 | OCONH | p-phenylene | 0 | NHCO | 18 |
| 1(3-) | (4-OH) | 0 | NHCOO | p-phenylene | 0 | CONH | 20 |
| 1(4-) | (3-OH) | 0 | OCONH | p-phenylene | 0 | NHCONH | 18 |
| 1(4-) | (3-$OCH_3$) | 1 | NHCOO | p-phenylene | 0 | OCO | 14 |
| 1(4-) | (3-OH) | 0 | OCONH | p-phenylene | 0 | COO | 18 |
| 1(4-) | (3-Cl) | 0 | NHCOO | p-phenylene | 0 | $SO_2$ | 18 |
| 1(4-) | (3-OH) | 0 | OCONH | p-phenylene | 0 | $SO_2NH$ | 18 |
| 1(4-) | — | 0 | OCO | — | 0 | — | 18 |
| 1(4-) | — | 1 | COO | — | 0 | — | 20 |
| 2(3-,5-) | — | 0 | OCO | — | 0 | — | 14 |
| 2(4-) | (3-OH) | 0 | COO | — | 0 | — | 18 |
| 1(4-) | (2-$CH_3$) | 0 | OCO | — | 0 | — | 16 |

TABLE 7-continued

| n | R | p | X | B | q | Y | r |
|---|---|---|---|---|---|---|---|
| 1(4-) | (3-Cl) | 2 | COO | — | 0 | — | 18 |
| 1(3-) | (4-OH) | 0 | OCO | — | 0 | — | 22 |
| 1(4-) | (3-OH) | 0 | COO | — | 6 | O | 14 |
| 1(4-) | (3-OH) | 1 | OCO | p-phenylene | 0 | O | 18 |
| 1(4-) | (3-Cl) | 0 | COO | p-phenylene | 0 | S | 16 |
| 1(3-) | (4-OH) | 0 | OCO | p-phenylene | 0 | NHCO | 18 |
| 1(3-) | (4-OH) | 0 | COO | p-phenylene | 0 | CONH | 20 |
| 1(4-) | (3-OH) | 0 | OCO | p-phenylene | 0 | NHCONH | 18 |
| 1(4-) | (3-$OCH_3$) | 1 | COO | p-phenylene | 0 | OCO | 14 |
| 1(4-) | (3-OH) | 0 | OCO | p-phenylene | 0 | COO | 18 |
| 1(4-) | (3-Cl) | 0 | COO | p-phenylene | 0 | $SO_2$ | 18 |
| 1(4-) | (3-OH) | 0 | OCO | p-phenylene | 0 | $SO_2NH$ | 18 |
| 1(4-) | — | 0 | O | — | 0 | — | 18 |
| 1(4-) | — | 2 | S | — | 0 | — | 20 |
| 2(3-,4-) | — | 0 | O | — | 0 | — | 14 |
| 2(4-) | (3-OH) | 0 | S | — | 0 | — | 18 |
| 1(4-) | (2-$CH_3$) | 0 | O | — | 0 | — | 16 |
| 1(4-) | (3-Cl) | 2 | S | — | 0 | — | 18 |
| 1(3-) | (4-OH) | 0 | O | — | 0 | — | 22 |
| 1(4-) | (3-OH) | 0 | S | — | 6 | O | 14 |
| 1(4-) | (3-OH) | 1 | O | p-phenylene | 0 | O | 18 |
| 1(4-) | (3-Cl) | 0 | S | p-phenylene | 0 | CO | 16 |
| 1(3-) | (4-OH) | 0 | O | p-phenylene | 0 | NHCO | 18 |
| 1(3-) | (4-OH) | 0 | S | p-phenylene | 0 | CONH | 20 |
| 1(4-) | (3-OH) | 0 | O | p-phenylene | 0 | NHCONH | 18 |
| 1(4-) | (3-$OCH_3$) | 1 | S | p-phenylene | 0 | OCO | 14 |
| 1(4-) | (3-OH) | 0 | O | p-phenylene | 0 | COO | 18 |
| 1(4-) | (3-Cl) | 0 | S | p-phenylene | 0 | $SO_2$ | 18 |
| 1(4-) | (3-OH) | 0 | O | p-phenylene | 0 | $SO_2NH$ | 18 |
| 1(4-) | — | 0 | $SO_2$ | — | 0 | — | 18 |
| 1(4-) | — | 1 | $SO_2NH$ | — | 0 | — | 20 |
| 2(3-,5-) | — | 0 | $SO_2$ | — | 0 | — | 14 |
| 2(4-) | (3-OH) | 0 | $SO_2NH$ | — | 0 | — | 18 |
| 1(4-) | (2-$CH_3$) | 0 | $SO_2$ | — | 0 | — | 16 |
| 1(4-) | (3-Cl) | 2 | $SO_2NH$ | — | 0 | — | 18 |
| 1(3-) | (4-OH) | 0 | $SO_2$ | — | 0 | — | 22 |

TABLE 7-continued

| n | R | p | X | B | q | Y | r |
|---|---|---|---|---|---|---|---|
| 1(4-) | (3-OH) | 0 | $SO_2NH$ | — | 6 | O | 14 |
| 1(4-) | (3-OH) | 1 | $SO_2$ | p-phenylene | 0 | O | 18 |
| 1(4-) | (3-Cl) | 0 | $SO_2NH$ | p-phenylene | 0 | S | 16 |
| 1(3-) | (4-OH) | 0 | $SO_2$ | p-phenylene | 0 | NHCO | 18 |
| 1(3-) | (4-OH) | 0 | $SO_2NH$ | p-phenylene | 0 | CONH | 20 |
| 1(4-) | (3-OH) | 0 | $SO_2$ | p-phenylene | 0 | NHCONH | 18 |
| 1(4-) | (3-$OCH_3$) | 1 | $SO_2NH$ | p-phenylene | 0 | OCO | 14 |
| 1(4-) | (3-OH) | 0 | $SO_2$ | p-phenylene | 0 | COO | 18 |
| 1(4-) | (3-Cl) | 0 | $SO_2NH$ | p-phenylene | 0 | $SO_2$ | 18 |
| 1(4-) | (3-OH) | 0 | $SO_2$ | p-phenylene | 0 | $SO_2NH$ | 18 |

The developer may also be a phenol compound having a structure for controlling the aggregation of molecules. The phenol compound may be represented by Formula (3),

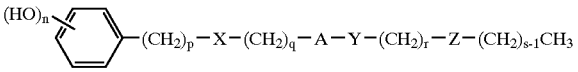

(3)

Characteristic examples of the phenol compound represented by Formula (3) are listed below in Tables 8 to 11 using the symbols p, q, r, s, A, X, Y, and Z. It is noted that n in phenol represents 1 to 3 throughout the tables. For example, the phenyl group contains at least one hydroxyl group such as 4-hydroxyphenyl, 3-hydroxyphenyl, 2-hydroxyphenyl, 2,4-dihydroxyphenyl, 3,4-dihydroxyphenyl, or 3,4,5-trihydroxyphenyl. The phenyl group may have other group than hydroxyl group. Also instead of the phenyl group, other aromatic ring group having phenollic hydroxyl group may be replaced.

TABLE 8

| p | X | q | A | Y | r | Z | s |
|---|---|---|---|---|---|---|---|
| 0 | NHCO | 0 | — | — | 0 | — | 21 |
| 2 | NHCO | 0 | — | — | 0 | — | 18 |
| 2 | NHCO | 1 | — | NHCONH | 0 | — | 16 |
| 0 | NHCO | 1 | — | NHCO | 0 | — | 19 |
| 0 | NHCO | 1 | — | NHCOCONH | 0 | — | 18 |
| 0 | NHCO | 1 | — | NHCO | 3 | NHCONH | 18 |
| 2 | NHCO | 2 | — | CONH | 0 | — | 18 |
| 0 | NHCO | 5 | — | NHCONH | 0 | — | 18 |
| 0 | NHCO | 10 | — | NHCOCONH | 0 | — | 14 |
| 0 | NHCO | 2 | — | CONHNHCO | 0 | — | 17 |
| 2 | NHCO | 10 | — | CONHCONH | 0 | — | 16 |
| 0 | NHCO | 7 | — | NHCONHCO | 0 | — | 11 |
| 0 | NHCO | 6 | — | CONHNHCONH | 0 | — | 18 |
| 2 | NHCO | 11 | — | NHCONHNHCO | 0 | — | 17 |
| 0 | NHCO | 3 | — | NHCONHNH | 0 | — | 18 |
| 0 | NHCO | 5 | — | SO2 | 0 | — | 18 |
| 0 | NHCO | 5 | — | NHCO | 5 | NHCONH | 14 |
| 2 | NHCO | 11 | — | CONH | 1 | CONHNHCO | 13 |
| 0 | NHCO | 1 | p-phenylene | O | 0 | — | 18 |
| 0 | NHGO | 2 | p-phenylene | NHCONH | 0 | — | 18 |
| 0 | NHCO | 4 | — | OCO | 0 | — | 15 |
| 0 | NHCO | 6 | — | SCO | 0 | — | 17 |
| 2 | NHCO | 2 | — | OCONH | 0 | — | 14 |
| 0 | NHCO | 10 | — | S | 0 | — | 20 |

TABLE 9

| p | X | q | A | Y | r | Z | s |
|---|---|---|---|---|---|---|---|
| 1 | CONH | 6 | — | $SO_2$ | 0 | — | 21 |
| 2 | CONH | 3 | — | COO | 0 | — | 18 |

TABLE 9-continued

| p | X | q | A | Y | r | Z | s |
|---|---|---|---|---|---|---|---|
| 1 | CONH | 1 | — | NHCO | 0 | — | 19 |
| 2 | CONH | 2 | — | CONH | 0 | — | 18 |
| 2 | CONH | 5 | — | NHCONH | 0 | — | 18 |
| 1 | CONH | 10 | — | NHCOCONH | 0 | — | 14 |
| 2 | CONH | 2 | — | CONHNHCO | 0 | — | 17 |
| 2 | CONH | 10 | — | CONHCONH | 0 | — | 16 |
| 3 | CONH | 7 | — | NHCONHCO | 0 | — | 11 |
| 1 | NHCONH | 6 | — | CONHNHCONH | 0 | — | 18 |
| 2 | NHCONH | 11 | — | NHCOCONH | 0 | — | 16 |
| 2 | NHCONH | 3 | — | CONH | 0 | — | 18 |
| 1 | NHCONH | 5 | — | $SO_2$ | 0 | — | 18 |
| 2 | NHCONH | 5 | — | CONHNHCO | 5 | NHCONH | 18 |
| 2 | CONHNHCO | 11 | — | NHCO | 0 | — | 14 |
| 1 | CONHNHCO | 6 | — | O | 6 | NHCOCONH | 18 |
| 2 | CONHNHCO | 2 | p-phenylene | NHCONH | 0 | — | 18 |
| 2 | COO | 1 | — | NHCO | 0 | — | 19 |
| 1 | COO | 5 | — | NHCONH | 0 | — | 18 |
| 2 | COO | 2 | — | CONHNHCO | 0 | — | 17 |
| 2 | COO | 7 | — | NHCONHCO | 0 | — | 11 |
| 2 | COO | 11 | — | NHCONHNHCO | 0 | — | 17 |
| 2 | COO | 3 | — | NHCONHNH | 0 | — | 18 |
| 1 | COO | 5 | — | $SO_2$ | 0 | — | 18 |
| 2 | COO | 11 | — | CONH | 1 | CONHNHCO | 14 |
| 2 | COO | 2 | p-phenylene | NHCONH | 0 | — | 18 |
| 3 | SCO | 5 | — | NHCONH | 0 | — | 18 |
| 2 | COS | 10 | — | NHCOCONH | 0 | — | 14 |
| 6 | SCO | 2 | — | NHCONHNHCO | 0 | — | 17 |
| 2 | COS | 10 | — | NHCONHCO | 0 | — | 16 |
| 2 | CONH | 7 | — | CONHNHCO | 0 | — | 11 |
| 1 | CONH | 6 | — | CONHNHCONH | 0 | — | 18 |
| 2 | CONH | 2 | — | NHCONHNHCO | 0 | — | 17 |
| 2 | CONH | 3 | — | NHCONHNH | 0 | — | 18 |
| 3 | CONH | 5 | — | $SO_2$ | 0 | — | 18 |
| 1 | CONH | 6 | — | NHCO | 5 | NHCONH | 18 |
| 2 | CONH | 11 | — | CONH | 1 | — | 14 |
| 2 | CONH | 4 | — | O | 0 | NHCOCONH | 18 |
| 1 | CONH | 2 | p-phenylene | NHCONH | 0 | — | 18 |
| 1 | NHCOCONH | 10 | — | CONH | 0 | — | 22 |
| 2 | NHCOCONH | 3 | — | $SO_2$ | 0 | — | 18 |
| 2 | OCONH | 4 | — | NHCO | 0 | — | 19 |
| 2 | NHCOO | 2 | — | CONH | 0 | — | 18 |
| 3 | OSONH | 5 | — | NHCONH | 0 | — | 18 |
| 2 | $NHSO_2$ | 10 | — | NHCOCONH | 0 | — | 14 |
| 1 | $NHSO_2$ | 2 | — | CONHNHCO | 0 | — | 17 |
| 2 | NHSOO | 7 | — | NHCONHCO | 0 | — | 11 |
| 3 | $SO_2$ | 6 | — | CONHNHCONH | 0 | — | 18 |
| 2 | $SO_2$ | 11 | — | NHCONHNHCO | 0 | — | 17 |
| 1 | $SO_2$ | 3 | — | NHCONHNH | 0 | — | 18 |
| 2 | NHCO | 1 | — | NHCOCONH | 0 | — | 16 |
| 2 | NHCO | 1 | — | NHCONH | 0 | — | 14 |
| 1 | CONHNHCO | 1 | — | NHCONHNH | 0 | — | 18 |
| 2 | CONHNHCO | 1 | — | $NHSO_2$ | 0 | — | 18 |
| 2 | NHCONHCO | 1 | — | NHCONHCO | 0 | — | 17 |
| 1 | NHCONHCO | 1 | — | NHCO | 10 | NHCONH | 18 |
| 2 | CONHCO | 1 | — | NHNHCONH | 0 | — | 12 |

TABLE 10-1

| p | X | q | A | Y | r | Z | s |
|---|---|---|---|---|---|---|---|
| 0 | CONHCONH | 8 | — | $SO_2$ | 0 | — | 18 |
| 0 | CONHCONH | 5 | — | NHCO | 5 | NHCONH | 18 |
| 0 | CONHCONH | 11 | — | CONH | 0 | — | 14 |
| 0 | CONHCONH | 2 | p-phenylene | O | 0 | — | 18 |
| 0 | CONHCONH | 2 | p-phenylene | S | 0 | — | 18 |
| 0 | CONHCONH | 2 | p-phenylene | COO | 0 | — | 21 |
| 0 | CH═N | 10 | — | NHCOCONH | 0 | — | 18 |
| 0 | CH═N | 1 | — | NHCONH | 0 | — | 20 |
| 0 | CH═N | 2 | p-phenylene | CONH | 0 | — | 18 |

TABLE 10-1-continued

| p | X | q | A | Y | r | Z | s |
|---|---|---|---|---|---|---|---|
| 0 | CONH | 0 | — | — | 0 | — | 22 |
| 0 | COO | 0 | — | — | 0 | — | 16 |
| 0 | S | 0 | — | — | 0 | — | 18 |
| 0 | $NHSO_2$ | 0 | — | — | 0 | — | 14 |
| 0 | $SO_2$ | 0 | — | — | 0 | — | 18 |
| 0 | O | 0 | — | — | 0 | — | 20 |
| 0 | OCOO | 0 | — | — | 0 | — | 18 |
| 0 | $SO_2NH$ | 0 | — | — | 0 | — | 18 |
| 0 | NHCONH | 0 | — | — | 0 | — | 18 |
| 0 | COS | 0 | — | — | 0 | — | 14 |
| 0 | SCO | 0 | — | — | 0 | — | 17 |
| 0 | $NHSO_2$ | 0 | — | — | 0 | — | 18 |
| 0 | NHCOO | 0 | — | — | 0 | — | 22 |

TABLE 10-1-continued

| p | X | q | A | Y | r | Z | s |
|---|---|---|---|---|---|---|---|
| 0 | NHSONH | 0 | — | — | 0 | — | 18 |
| 0 | N═CH | 0 | — | — | 0 | — | 17 |
| 0 | CO | 0 | — | — | 0 | — | 15 |
| 0 | CONHNHCO | 0 | — | — | 0 | — | 18 |
| 0 | OCO | 0 | — | — | 0 | — | 17 |
| 0 | OCONH | 0 | — | — | 0 | — | 16 |
| 0 | SCOO | 0 | — | — | 0 | — | 14 |
| 0 | SCONH | 0 | — | — | 0 | — | 18 |
| 0 | NHCOCONH | 0 | — | — | 0 | — | 18 |

TABLE 10-1-continued

| p | X | q | A | Y | r | Z | s |
|---|---|---|---|---|---|---|---|
| 1 | NHCO | 0 | — | — | 0 | — | 17 |
| 3 | NHCO | 0 | — | — | 0 | — | 15 |
| 2 | NHCONH | 0 | — | — | 0 | — | 18 |
| 1 | NHCONH | 0 | — | — | 0 | — | 16 |
| 4 | CONHNHCO | 0 | — | — | 0 | — | 17 |
| 2 | CONHNHCO | 0 | — | — | 0 | — | 21 |
| 2 | NHCOCONH | 0 | — | — | 0 | — | 18 |
| 2 | CONHCONH | 0 | — | — | 0 | — | 20 |
| 2 | OCONH | 0 | — | — | 0 | — | 18 |

TABLE 11-1

| p | X | q | A | Y | r | Z | s |
|---|---|---|---|---|---|---|---|
| 0 | NHCO | 0 | p-phenylene | O | 0 | — | 22 |
| 0 | NHCO | 0 | p-phenylene | NHCONH | 0 | — | 18 |
| 0 | CONH | 0 | p-phenylene | CONH | 0 | — | 18 |
| 0 | CONH | 0 | p-phenylene | CONHNHCO | 0 | — | 17 |
| 0 | $NHSO_2$ | 0 | p-phenylene | NHCO | 0 | — | 19 |
| 0 | S | 0 | p-phenylene | CONH | 0 | — | 18 |
| 0 | S | 0 | p-phenylene | NHCOO | 0 | — | 18 |
| 0 | S | 0 | p-phenylene | NHCOCONH | 0 | — | 16 |
| 0 | NHCONH | 0 | p-phenylene | NHCONH | 0 | — | 14 |
| 0 | NHCONH | 0 | p-phenylene | CONHNHCO | 0 | — | 17 |
| 0 | CH═N | 0 | p-phenylene | CONHCONH | 0 | — | 16 |
| 0 | N═CH | 0 | p-phenylene | S | 0 | — | 18 |
| 0 | NHCSNH | 0 | p-phenylene | COO | 0 | — | 20 |
| 0 | S | 1 | p-phenylene | NHCONH | 0 | — | 18 |
| 0 | S | 2 | p-phenylene | NHCONHNH | 0 | — | 18 |
| 0 | NHCO | 1 | p-phenylene | NHCONHCO | 0 | — | 19 |
| 0 | NHCO | 2 | p-phenylene | NHCO | 0 | — | 17 |
| 0 | CONH | 2 | p-phenylene | OCONH | 0 | — | 18 |
| 0 | CONH | 1 | p-phenylene | CONHNHCO | 0 | — | 17 |
| 0 | CONH | 1 | — | NHCO | 0 | — | 21 |
| 0 | CONH | 2 | — | NHCONH | 0 | — | 18 |
| 0 | S | 2 | — | NHCONH | 0 | — | 19 |
| 0 | S | 10 | — | NHCONH | 0 | — | 18 |
| 0 | S | 2 | — | CONHNHCO | 0 | — | 17 |
| 0 | S | 2 | — | CONHNHCONH | 0 | — | 14 |
| 0 | S | 1 | — | CONH | 0 | NHCONH | 18 |
| 0 | S | 2 | — | CONH | 1 | NHCO | 17 |
| 1 | CONH | 1 | — | NHCO | 0 | — | 17 |
| 2 | CONH | 1 | — | NHCONH | 0 | — | 18 |
| 0 | NHCO | 1 | — | CONH | 0 | — | 18 |
| 0 | NHCO | 1 | — | CONHNHCO | 0 | — | 17 |
| 0 | CONHNHCO | 2 | — | S | 0 | — | 12 |
| 0 | CONHNHCO | 10 | — | S | 0 | — | 10 |
| 2 | CONHNHCO | 2 | — | S | 0 | — | 14 |
| 0 | S | 10 | — | CONHNHCO | 2 | S | 18 |
| 0 | $SO_2$NHCONH | 2 | p-phenylene | NHCONH | 0 | — | 18 |
| 0 | $SO_2$NHCONH | 0 | p-phenylene | COO | 0 | — | 18 |
| 0 | $SO_2$ | 10 | — | NHCONH | 0 | — | 18 |
| 0 | $SO_2$ | 6 | — | CONHNHCO | 0 | — | 19 |
| 0 | $SO_2$ | 0 | p-phenylene | CONHNHCO | 0 | — | 18 |

The colorant according to the present invention is of electron donor type and may be a non or pale color dye precursor (leuco dye) which is commonly selected, but not limited to, phthalide compound, azaphthalide compound, fluoran compound, phenothiazine compound, and leuco orlamine compound. Flavorable colorant may include as described below.

The colorant according to the present invention may have the following

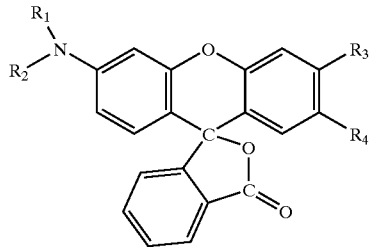

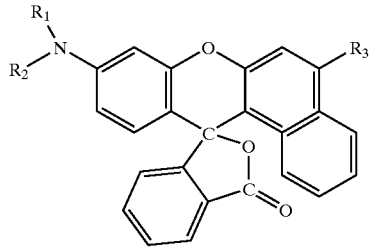

(where R1 is a hydrogen atom or an alkyl group having one to four carbon atoms, R2 is an alkyl group having one to six carbon atoms, cycloakyl group, or phenyl group, wherein the pheny group may be substituted by other group or groups, the other group(s) are alkyl group such as methyl, ethyl groups, alkoxy group such as methoxy, ethoxy groups, or halogen atom, R4 is a hydrogen atom, methyl group, halogen atom, or amino group which is possible to be substituted by other group consisting of alkyl group, aryl group which may be further substituted by halogen atom, alkyl, or an alkoxy group or groups).

Characteristic examples of the colorant are:

2-anilino-3-methyl-6-diethylamino fluoran,
2-anilino-3-methyl-6-di(n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-amilino-3-methyl-6-(N-n-amyl-N-ethylamino)fluoran,
2-anilino-3-methyl-6-(N-iso-amyl-N-ethylamino)fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylamino fluoran,
2-(m-triphloromethylanilino)-3-methyl-6-diethylamino fluoran,
2-(m-trichloromethylanilino)-3-methyl-6-(N-cyclohexyl-N-methylamino)fluoran, 2-(2,4-dimethylanilino)-3-methyl-6-diethylamino fluoran,
2-(N-ethyl-p-toluidino)-3-methyl-6-diethylamino fluoran,
2-(N-ethyl-p-toluidino)-3-methyl-6-(N-ethylanilino) fluoran,
2-(N-ethyl-p-toluidino)-3-methyl-6-(N-propyl-p-toluidino) fluoran,
2-anilino-6-(N-n-hexyl-N-ethylamino)fluoran,
2-(o-chloroanilino)-6-diethylamino fluoran, 2-(o-chloroanilino)-6-dibutylamino fluoran, 2-(m-trifluromethylanilino)-6-diethylamino fluoran,
2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)-fluoran,
2-benzylamino-6-(N-methyl-p-toluidino)fluoran,
2-benzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran, 2-methyl-6-(N-propylanilino) fluoran, 2-ethylamino-6-(N-methyl-p-toluidino)fluoran,
2-mthylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran, 2-amino-6-(N-methylanilino)fluoran, 2-amino-6-(N-ethylanilino) fluoran, 2-amino-6-(N-propylanilino)fluoran, 2-amino-6-(N-methyl-p-toluidino)fluoran,
2-amino-6-(N-ethyl-p-tokuidino)fluoran, 2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-diethylanilino)fluoran,
2-amino-6-(N-ethyl-2,4-diemthylanilino)fluoran,
2-amino-6-(N-propyl-2,4-dimethylanilino)fluoran,
2-amino-6-(N-methyl-p-chloroanilino)fluoran,
2-amino-6-(N-methyl-p-chloroanilino)fluoran,
2-amino-6-(N-ethyl-p-chloroanilino)fluoran,
2-amino-6-(N-propyle-p-chloroanilino)fluoran, 2,3-dimethyl-6-dimethylamino fluoran, 3-methyl-6-(N-ethyl-p-toludino)fluoran, 2-chloro-6-diethylamino fluoran, 2-bromo-6-diethylamino fluoran, 2-chloro-6-dipropylamino fluoran,
3-chloro-6-cyclohexylamino fluoran, 3-bromo-6-cyclohexylamino fluoran,
2-chloro-6-(N-ethyl-N-isoamylamino)fluoran,
2-chloro-3-methyl-6-diethylamino fluoran, 2-anilino-3-chloro-6-diethylamino
fluoran, 2-(o-chloroanilino)-3-chloro-6-chclohexylamino fluoran,
2-(m-triphloromethylanilio)-3-chloro-6-diethylamino fluoran,
2-2,3-dichloroanilino)-3-chloro-6-diethylamino fluoran,
1,2-benzo-6-diethylamino fluoran, 1,2-benzo-6-(N-ethyl-N-isoamylamino)fluoran, 1,2-benzo-6-dibutylamino fluoran,
1,2-benzo-6-(n-methyl-N-cyclohexylamino)fluoran, and
1,2-benzo-6-(N-ethyl-N-toluidino)fluoran.

Other characteristic examples of the colorant according to the present invention are: 2-anilino-3-methyl-6-(N-2-ethoxypropyl-N-ethylamino)fluoran, 2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino) fluoran,
2-dibenzylamino-4-methyl-6-diethylamino fluoran,
2-dibenzylamino-4-methoxy-6-(N-methyl-p-tolyidino) fluoran, 2-dibenzylamino-4-methyl-6-(N-ethyl-p-toluidino)fluoran,
2-(α-phenylethylamino)-4-methyl-6-diethylamino fluoran,
2-(p-toluidino)-3-(t-butyl)-6-(N-methyl-p-toluidino)fluoran,
2-(o-methoxycarbonylamino)-6-diethylamino fluoran,
2-acetylamino-6-(N-methyl-p-toluidino)fluoran,
3-diethylamoni-6-(m-triphloromethylanilino)fluoran,
4-methoxy-6-(N-ethyl-p-toluidino)fluoran,
2-ethoxyethylamino-3-chloro-6-dibutylamino fluoran,
2-dibenzylamino-4-chloro-6-(N-ethyl-p-toluidino)fluoran,
2-(α-phenylethylamino)-4-chloro-6-diethylamino fluoran,
2-(N-benzyl-p-triphloromethylanilino)-4-chloro-6-diethylamino fluoran,
2-anilino-3-methyl-6-pyrrolidino fluoran, 2-anilino-3-chloro-6-pyrrolidino fluoran, 2-anilino-3-methyl-6-(N-ethyl-N-tetrahydrofurfurylamino)fluoran,
2-mesidino-4',5'-benzo-6-diethylamino fluoran,
2-(m-triphloromethylanilino)-3-methyl-6-pyrrolidino fluoran,
2-(α-naphthylamino)-3,4-benzo-4'-bromo-6-(N-benzyl-N-chclohexylamino)fluoran, 2-pypepiperidino-6-diethylamino fluoran,
2-(N-n-propyl-p-triphloromethylanilino)-6-morpholino fluoran,
2-(di-N-p-chlorophenyl-methylamino)-6-pyrrolidino fluoran,
2-(N-n-propyl-m-triphloromethylanilino)-6-morpholino fluoran,
1,2-benzo-6-(N-ethyl-N-n-octylamino)fluoran, 1,2-benzo-6-diarylamino fluoran, 1,2-benzo-6-(N-ethoxyethyl-N-ethylamino)fluoran, benzoleucomethylene blue, 2-[3,6-bis(diethylamino)]-6-(o-chloroanilino)xanthyl benzoate lactam, 2-(3,6-diethylamino)-9-(o-chloroanilino)xanthyl benzoate lactam, 3,3-bis(p-dimethylaminophenyl)-6-dimethylamino phthalide (crystal violet lacton), 3,3-bis-(p-dimethylaminophenyl)-6-diethylamino phthalide, 3,3-bis-(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3-(2-methoxy-4-dimethylaminophenyl)-3-(2-hydroxy-chloro-5-methoxyphenyl)phthalide, 3,6-bis(dimethylamino)fluorenespiro(9,3')-6'-dimethylamino phthalide,
3-(1-ethyl-2-methylindole-3-il)-3-(2-ethoxy-4-diethylaminophenyl)-4-azaphthalide,
3-(1-octyl-2-methylindole-3-il)-3-(2-ethoxy-4-diethylaminophenyl)-4-azaphthalide,
3-(1-ethyl-2-methylindole-3-il)-3-(2-ethoxy-4-diethylaminophenyl)-4-azaphthalide, 3,3-bis(2-ethoxy-4-diethylaminophenyl)-7-azaphthalide,
6'-chloro-8'-methoxy-benzoindolino-spiropyran, and
6'-bromo-2'-mthoxy-benzoindolino-spiropyran.

The ratio of the colorant and the developer in the recording layer may be varied depending on the ingredients of a compound to be used. In general, the molar ratio of the developer to the colorant ranges preferably from 0.1:1 to 20:1 and more preferably from 0.2:1 to 10:1. When the ratio of the developer is smaller or greater than the range, the concentration of coloring will unfavorably be declined. Also, both the colorant and the developer may be packaged in micro-capsules.

The ratio of the resin to the coloring component in the recording layer is preferably 0.1:1 to 10:1. If smaller, the thermal strength of the recording layer will be declined. If greater, the coloring density will unfortunately be declined.

The recording layer may be fabricated from a coating solution prepared by uniformly dispersing a mixture of the developer, the colorant, and the curable resin containing a resin being bridged, into a liquid solvent. Characteristic examples of the solvent are: water; alcohol such as methanol, ethanol, isopropanol, n-butanol, or methyl isocarbinol; ketone such as acetone, 2-butanon, ethyl amyl ketone, diacetone alcohol, isophorone, or cyclohexanon; amide such as N,N-dimethyl formamide, or N,N-dimethyl acetoamide; ether such as diethyl ether, isopropyl ether, tetrahydrofuran, 1,4-dioxyan, or 3,4-dihydro-2H-pylan; glycol ether such as 2-methoxy ethanol, 2-ethoxy ethanol, 2-butoxy ethanol, or ethylene glycol dimethyl ether; glycol ether acetate such as 2-methoxy ethyl acetate, 2-ethoxy ethyl acetate, or 2-butoxy ethyl acetate; ester such as methyl acetate, ethyl acetate, isobutyl acetate, amyl acetate, ethyl lactate, or ethylene carbonate; aromatic hydrocarbon such as hexane, heptane, iso-octane, or cyclohexane; halogenated hydrocarbon such as 1,2-dichlorethane, dichloropropane, or chlorbenzene; sulfoxide such as dimethyl sulfoxide; and pyrrolidone such as N-methyl-2-pyrrolidone or N-octyl-2-pyrrolidone.

The solvent for preparing the coating solution may be a mixture of two or more solvents. Preferably, a mixture of a low boiling point solvent and a high boiling point solvent is used for improving the formation of the layer.

The coating solution may be prepared by using a known dispersing apparatus for coating solution such as a paint shaker, a ball mill, an attrition mill, a three-roll mill, a Keddy mill, a sand mill, a dino-mill, or a colloid mill. The dispersing apparatus may also be used for dispersing the mixture into the solvent or for mixing the ingredients in the solvent. Alternatively, the layer may be deposited through rapid or slow cooling down after heating up the preparation.

The procedure of forming the recording layer is of no limitations and may be implemented by using any appropriate known manner such as blade coating, wire bar coating, spraying, air-knife coating, beads coating, curtain coating, gravure coating, kiss coating, reverse roll coating, dipping, or die coating.

The recording layer is subjected to curing process, if needed, after the coating and drying process. The layer may be heated in a high-temperature bath when its bridging action requires heat. Alternatively, the layer may be cured by a known curing apparatus using ultraviolet ray or electron beam. For example, the source for emitting an ultraviolet ray is selected from a type of lamps, which can emit light of a given spectrum corresponding to the ultraviolet of wavelength absorbed to the photo polymerization nitiator or accelerator, including a mercury lamp, a metal-halide lamp, a gallium lamp, a mercury-xenon lamp, a flash lamp, and the like. The condition for emitting of ultraviolet ray may be determined by the output power of lamp and the transporting speed of the resin to be bridged, in accordance to the required energy intensity of the radiation output, and the speed depending on the energy of radiation. The electron beam emitter apparatus may be selected from scanning type and non-scanning type depending on the requirements including the area to be radiated and the intensity of radiation. The requirements for radiation, such as the flow of electrons, the radiation width, and the transporting speed, are determined by the bridging process of the resin. The thickness of the recording layer may be preferably 1 to 20 μm or more preferably 3 to 10 μm.

The supporting substrate in the reversible thermosensitive recording medium of the present invention may be selected from paper, resin film, synthetic paper, metallic foil, glass, and their composition, suitable for supporting the recording layer.

The thickness of the supporting substrate can be determined depending on the usage.

An information storage means may be provided partially or entirely over the front or back sides of the supporting substrate. The information storage means are selected from, but not limited to, a magnetic recording layer such as a magnetic stripe or a magnetic track, an IC chip, and an optical recording layer.

The supporting substrate may also has an adhesive or tacking layer provided on the back side thereof, thus constituting a thermosensitive recording label. The label can thus be attached to any target to be labeled. The target to be labeled is selected from, but not limited to, a vinyl chloride card such as a credit card, an IC card or chip, an ID card, paper, plastic film, synthetic paper, a boarding pass, a commuter card, disk cartridge, a cassette tape, a CD-R, a CD-WR, and a DVD.

In case that the thermosensitive recording medium having supporting substrate therefor and provided with an adhesive layer is attached as a thermosensitive recording label by thermal bonding to a target to be labeled, the melting point of the lubricant being contained in its protective layer is preferably not lower than that of the thermal bonding. If the melting point of the lubricant is lower than the temperature of the thermal bonding, the lubricant may melt down during the thermal bonding, transfer to the thermal bonding head, and tar the thermosensitive recording medium as well as the thermal bonding head.

FIG. 5 illustrates a basic structure of the thermosensitive recording medium according to the present invention. Also, other examples of the structure are shown in FIGS. 6*a* to 6*n* but of no limitations.

The reversible thermosensitive recording medium of the present invention may also be provided with additive for improving or controlling the ease of coating and the coloring and de-coloring properties of the recording layer. The additive may be selected from a dispersant, a surfactant, a conductive agent, a filler, a lubricant, an anti-oxidant, an anti-light fastness agent, an ultraviolet absorber, a coloring stabilizer, and a de-coloring stabilizer, and their combination.

The recording layer may include thermoplastic resins in addition to the curable resin for bridging. Characteristic examples of the binder resin are polyvinyl chloride, polyvinyl acetate, polyvinyl chloride/polyvinyl acetate copolymer, polystyrene, styrene copolymer, phenoxy resin, polyester, aromatic polyester, polyurethane, polycarbonate, polyacrylic acid ester, polymethacrylic acid ester, acrylic copolymer, and maleic copolymer.

<Protective Layer>

The protective layer according to the present invention contains at least a filler and a curable resin. The curable resin may be selected from the group of materials employed for the recording layer.

The filler in the protective layer is classified into an inorganic filler and an organic filler. The inorganic filler may be selected from carbonate such as calcium carbonate or magnesium carbonate, silicate such as silicic acid anhydride, hydrated aluminum silicate, or hydrated calcium silicate, oxide such as alumina, zinc oxide, iron oxide, or calcium oxide, and hydroxide such as aluminum hydroxide. In particular, when particles of the filler have a diameter of not greater than 0.1 μm on average, the reversible thermosensitive recording medium can be improved in the resistive to light. The inorganic filler may be selected from: metal oxide such as zinc oxide, indium oxide, alumina, silica, zircon oxide, tin oxide, cerium oxide, iron oxide, antimony oxide, barium oxide, calcium oxide, bismuth oxide, nickel oxide, magnesium oxide, chrome oxide, manganese oxide, tantalum oxide, niobium oxide, thorium oxide, hafnium oxide, molybdenum oxide, iron ferrite, nickel ferrite, cobalt ferrite, barium titanate, potassium titanate; their hybrid oxides; metal carbide such as titan carbide, silicon carbide, molybdenum carbide, tungsten carbide, or tantalum carbide; and metal nitride such as aluminum nitride, silicon nitride, boron nitride, zirconium nitride, vanadium nitride, titan nitride, niobium nitride, or gallium nitride.

The organic filler may be selected from styrene resin such as silicon resin, cellulose resin, epoxy resin, nylon resin, phenol resin, polyurethane resin, urea resin, melamine resin, polyester resin, polycarbonate resin, polystyrene, polystyrene-isoprene, or styrene-vinyl benzene; acryl resin such as acrylic acid ester/vinylidene chloride, acryl urethane, or ethylene acryl resin; formaldehyde resin such as polyethylene resin, benzoguanamine formaldehyde resin, or melamine formaldehyde resin; polymethyl methacrylate resin; and vinyl chloride resin.

In particular, when particles of the filler have a diameter of not greater than 6 μm on average, the recording medium can be improved in the mechanical durability. The organic filler according to the present invention may comprise one or more filler materials and be based on composite particles. The filler may be provided in a spherical, granular, sheet-like, or needle-like shape. When the filler is arranged of spherical particles, the recording medium can be enhanced in the mechanical durability.

The filler may have preferably an oil absorption level of not smaller than 20 ml/100 g, more preferably than 50 ml/100 g, or most preferably than 100 ml/100 g. As the filler having a higher level of the oil absorption is contained in the protective layer, it can absorb a redundancy of the lubricant heated and melted down during the printing or erasing process of the thermosensitive recording medium hence inhibiting an ooze out of the lubricant and minimizing declination of the lubricating properties after a series of printing and erasing actions.

The thickness of the protective layer is preferably 0.1 to 20 μm and more preferably 0.3 to 10 μm. Also, the content of the filler in the protective layer ranges 1% to 95% by volume and preferably from 5% to 75%. The protective layer may contain an organic ultraviolet absorbent which ranges preferably from 0.5 part to 10 parts by weight for 100 parts by weight of the binder.

The solvent used for preparation of coating liquid for the protective layer, its dispersing apparatus, the forming of the protective layer, the drying of the protective layer, and the curing of the protective layer may be carried out using known methods similar to those for fabricating the recording layer. The solvent according to the present invention is preferably arranged not to dissolve 10% or more of the lubricant and may be a mixture of solvents. More preferably, the solvent is capable of dissolving not higher than 5% of the lubricant. If the degree dissolved is higher, it may appear at the surface of the protective layer being fabricated, thus impeding the secondary processing properties of the recording medium such as ease of printing.

The surface roughness Rz and smoothness Sm of the reversible thermosensitive recording medium of the present invention conform to JIS B0601. The roughness Rz represents an average rise of ten measurements on the coating surface. The smoothness Sm represents the distance on average between two rises. It is assumed that both are measured when the cutoff is 0.8 mm, the measuring length is 2.5 mm, the scanning seed is 0.3 mm/s, and the probe hook curvature is 5 μm. The measurement can be carried out using a surface roughness measuring apparatus, Surf Com 570A (made by Tokyo Seimitsu Corp).

When the surface roughness Rz is declined to 1.5 μm or lower, the head matching will be declined thus causing sticking or transfer fault. Simultaneously, the thermal head will be declined in the soil-removing function.

Accordingly, the surface roughness Rz of the thermosensitive recording medium of the present invention is preferably higher than 1.5 μm. When so, the area of contact between the thermal head and the thermosensitive recording medium is decreased thus lowering the stress exerted on the thermosensitive recording medium during the printing or erasing action and improving the matching between the thermal head and the recording medium. Also, there is developed a gap between the thermal head and the thermosensitive recording medium for ease of removing the soil and the removal of soil from the thermal head will be accelerated. More preferably, the surface roughness is higher than 2.0 μm. If the Rs value exceeds 5 μm, the gap of air at the contact area will be too large to be filled up with the lubricant. As a result, unfavorable effects will appear including declination in the printing sensitivity, variations in the printing sensitivity, error in the erasing action, variations in the energy for erasing, and an increasing effect of the external temperature during the printing and erasing actions. As described, the surface roughness is preferably not higher than 5.0 μm and more preferably not higher than 4.0 μm. The surface roughness may also create diffusion of light which significantly declines the tone of prints on the recording medium surface. The surface roughness Rz of the thermosensitive recording medium is preferably not higher than 3.5 μm and more preferably not higher than 3.0 μm for having a stable degree of legibility.

If the Sm/Rz exceeds 200, the soil-removing function on the thermal head will be declined.

The Sm/Rz at the surface of the thermosensitive recording medium of the present invention is preferably not greater than 200. The Sm/Rz is a ratio in the distance between two rises on the surface of the recording medium.

When the ratio is too large, the contact between the thermal head and the thermosensitive recording medium will be stable. Accordingly, as the thermosensitive recording medium is frequently stressed at the rises of its surface, it may be fractured thus declining the head matching. Also, if the gap of air is too large, it will hardly be filled up with the lubricant. This causes the thermosensitive recording medium to irregularly receive the energy at no steadiness hence impairing the stability in the printing and erasing action. The ratio is thus preferably not greater than 100. When the Sm/Rz is lower than 30, the surface of the recording medium will create diffusion of light hence declining the tone of prints. The Sm/Rz at the surface of the thermosensitive recording medium is preferably not lower than 30 and more preferably not lower than 50 for having a stable degree of legibility.

The coating strength of the thermosensitive recording medium of the present invention conforms to JIS K5400-1990, where the strength is determined against peel-off at a degree of smaller than 2/5.

When the strength at the surface of the thermosensitive recording medium is not higher than a level of the HB, the recording medium suffers from mechanical loads developed during the printing and erasing processes and its coating will be fractured causing the thermal head to be polluted with its soils and thus produce print smears. The costing strength at the surface of the thermosensitive recording medium of the present invention is not lower than the F and preferably not lower than the H.

Although the reversible thermosensitive recording medium of the present invention has substantially the thermosensitive recording layer and the protective layer, which contains the lubricant, fabricated on the supporting substrate, it may be provided further with an adhesive layer, an intermediate layer, an under-coat layer, and/or a back-coat layer for improving the recording properties.

The protective layer may be made of any other material than the described curable resin such as polyvinyl alcohol, styrene/maleic anhydride copolymer, carboxy denatured polyethylene, melamine/formaldehyde resin, or urea/formaldehyde resin.

<Intermediate Layer>

The intermediate layer may be provided between the recording layer and the protective layer for inhibiting the protective layer from deteriorating the recording layer and the adder in the protective layer from immigrating into the recording layer. The provision of the intermediate layer will improve the retention of developed images. Also, the intermediate layer like the protective layer may preferably be made of a specific resin having a low permeability of oxygen thus improving the resistance to light. This will prevent or minimize oxidation of the developer and the colorant contained in the recording layer.

The resin of the intermediate layer may be selected from polyvinyl chloride, polyvinyl acetate, polyvinyl chloride/polyvinyl acetate copolymer, polyvinyl acetal, polyvinyl butylal, polycarbonate, polyallylate, polysulfone, polyether sulfone, polyphenilene oxide, polyimide, fluorine resin, polyamide, polyamide imide, polybenzimidazol, polystyrene, styrene copolymer, phenoxy resin, polyester, aromatic polyester, polyurethane, polyacrylic ester, polymethacrlic ester, acrylic copolymer, maleic copolymer, epoxy resin, alkyd resin, silicon resin, phenol resin, polyvinyl alcohol, denatured polyvinyl alcohol, polyvinyl pyrrolidone, polyethylene oxide, polypropylene oxide, methyl cellulose, ethyl cellulose, carboxymethy cellulose, hydroxyethyl cellulose, starch, gelatin, casein, and other known materials. The intermediate layer may preferably be made of a curable resin identical to that for fabricating the recording layer or the protective layer for improving the resistance to light and more preferably be doped with filler identical to that contained in the protective layer.

The thickness of the intermediate layer is preferably 0.1 to 20 μm and more preferably 0.3 to 10 μm. The content of the filler in the intermediate layer ranges preferably from 1% to 95% by volume and more preferably from 5% to 75%. The intermediate layer may be doped with an organic ultraviolet absorbent with the content ranges preferably from 0.5 to 10 parts by weight in relation to 100 parts by weight of the binder.

The solvent preparation for forming the intermediate layer, its dispersing apparatus, the forming of the intermediate layer, the drying of the intermediate layer, and the curing of the intermediate layer may be carried out using known methods similar to those for fabricating the protective layer.

<Others>

The under-coat layer of a thermally insulating material may be provided between the supporting substrate and the recording layer for utilizing the heat applied. Such a thermally insulating layer may be fabricated by bonding organic or inorganic tiny hollow or balloon like particles together with a binder resin. The under-coat layer may have other properties including the improvement for bonding strength between the supporting substrate and the recording layer and the prevention of the recording layer material from penetrating into the supporting substrate.

The under-coat layer may be made of a resin identical to that for the recording layer. Also, the under-coat layer like the recording layer may be doped with an inorganic filler and/or an organic filler which are selected from calcium carbonate, magnesium carbonate, titan oxide, silicon oxide, aluminum hydroxide, kaolin, and talc. Moreover, the under-coat layer may be doped with a lubricant, a surfactant, and a dispersant.

For developing the color images on the reversible thermosensitive recording medium of the present invention, the medium may be heated to a temperature higher than the coloring level and cool it rapidly. More specifically, when the recording layer is locally heated for a short period of time by means of the thermal head or laser beam, only isolated area on the recording layer is heated, thus develops and holds a color image. The image can be erased when it is heated at a moderate temperature spending a relative long period of time or temporarily heated to a temperature slightly lower than the coloring level before cooled down. When the recording medium is heated for a long period of time, its temperature rises up throughout a significantly extensive area and then lowers slowly. This causes the image of color to be erased. The heating may be carried out using a heat roller, a heat stamp, or a hot blower other than the thermal head if desired. For example, the thermal head can favorably be controlled at its voltage application or pulse width to generate a desired energy of output for heating and erasing a desired region of the recording layer at a temperature lower than the coloring or recording level. This allows the thermal head to be operated for both the printing and erasing actions, hence enabling overwriting. It is of course feasible that the erasing action is carried out by the heat roller or the heat stamp with equal success.

DETAILED DESCRIPTION OF THE PREFERRED EMBODIMENT

EXAMPLES

Figure 1:
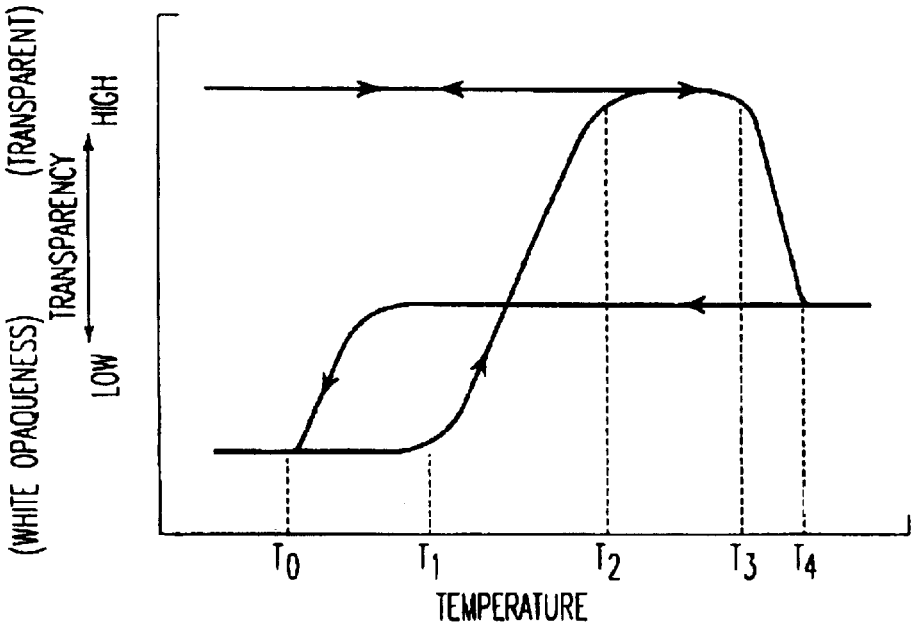
FIG. 1 is a diagram showing a profile of the transparency with relation to the temperature in accordance to the reversible thermosensitive recording medium of the present invention.
Figure 2:
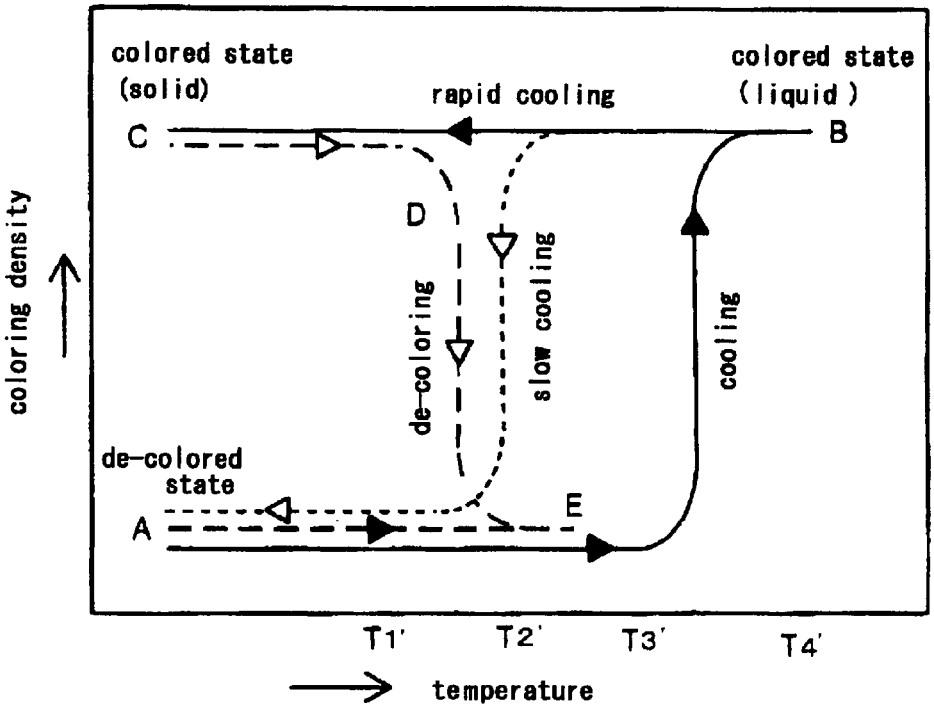
FIG. 2 is a diagram showing a profile of the color development density with relation to the temperature in accordance to the recording medium of the present invention.
Figure 3:
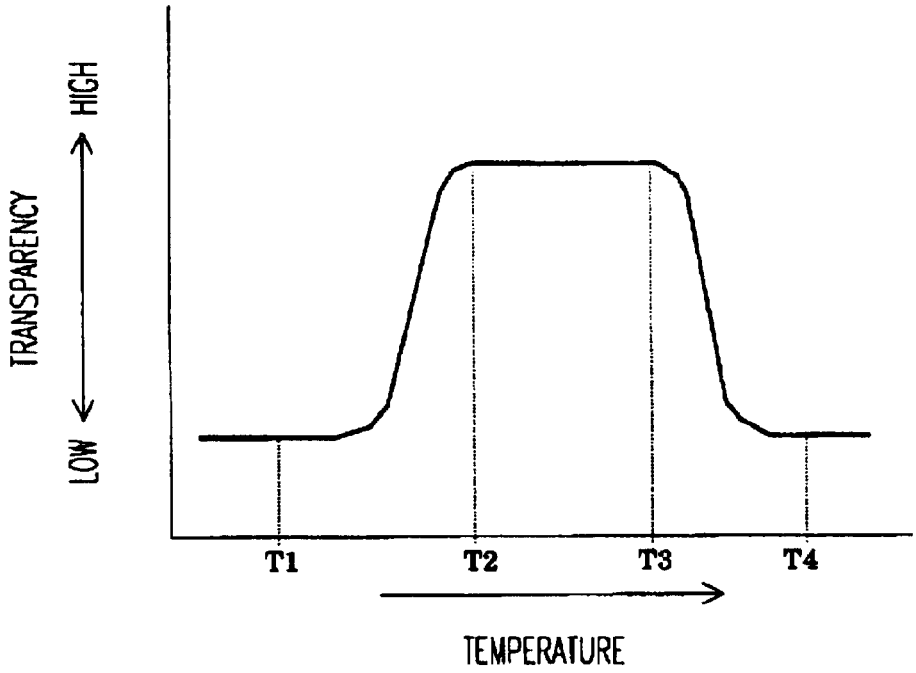
FIG. 3 is a diagram showing another profile of the transparency with relation to the temperature in accordance to the recording medium of the present invention.
Figure 4:
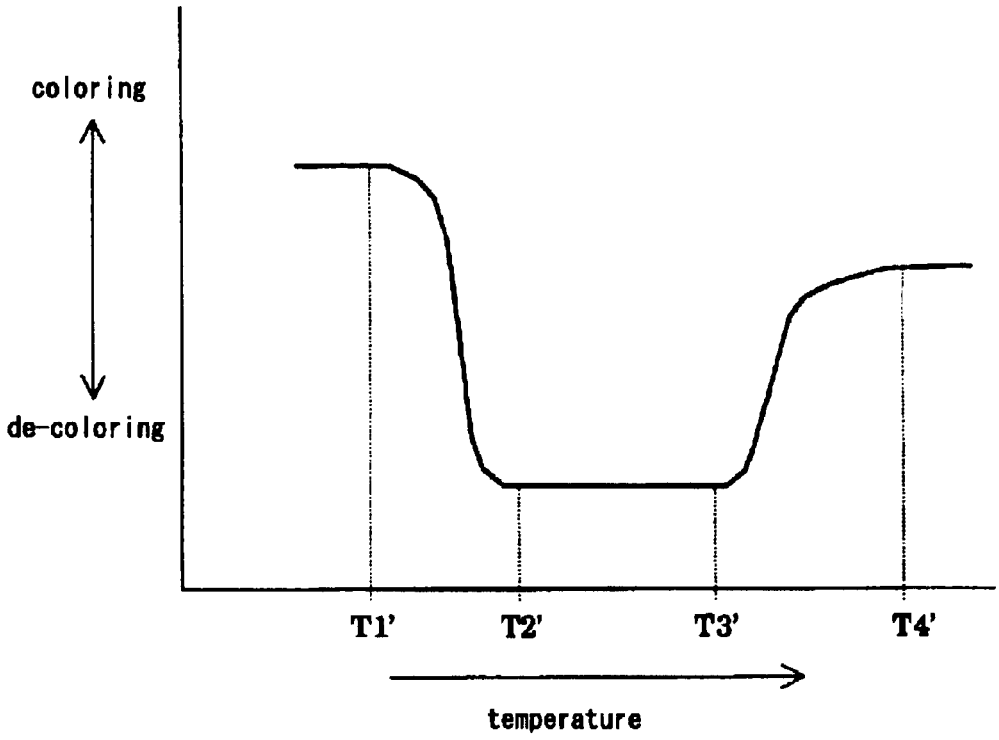
FIG. 4 is a diagram showing another profile of the color development density with relation to the temperature in accordance to the recording medium of the present invention.
Figure 5:
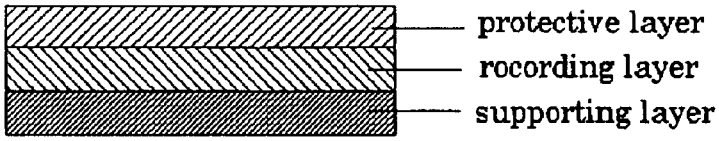
FIG. 5 is a diagram showing a basic structure of the recording medium according to the present invention.
Figure 6:
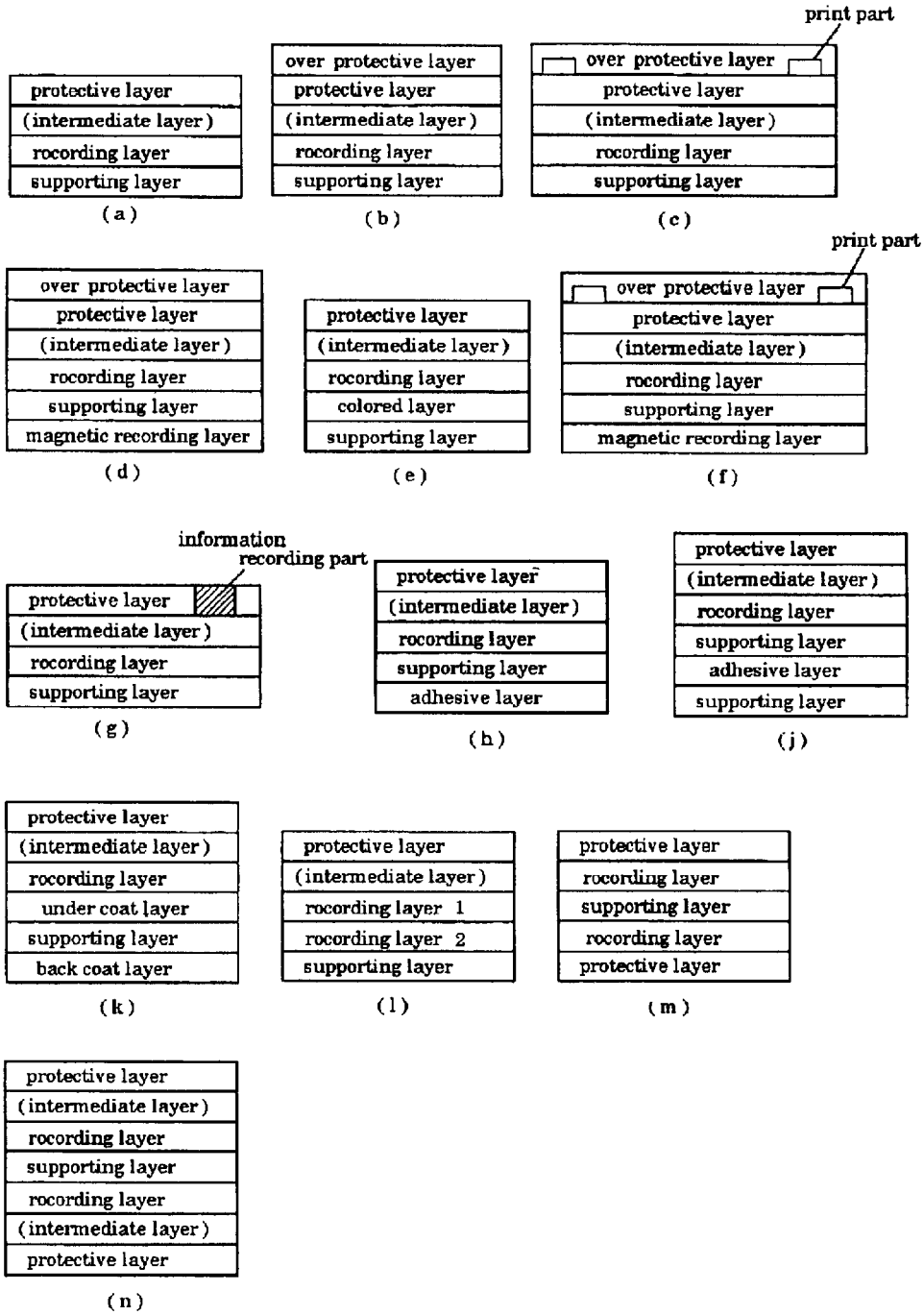
FIG. 6 is a diagram showing other structures of the recording medium according to the present invention.

The present invention will now be described in more detail by way of characteristic examples. The "parts" and "percentages" are by weight throughout the description.

| (Fabrication of Recording Layer A) | |
|---|---|
| A solution was provided comprising: | |
| Behenic acid (B-95 by Miyoshi Oil) | 5 parts |
| Eicosanoic acid (SL-20-90 by Okamura Oil) | 5 parts |
| Vinyl chloride copolymer (MR resin, MR 110 by Nippon Zeon) | 30 parts |
| Adduct type hexamethylene-diisocyanate 75% ethyl acetate solution (Collonate L by Nihon Polyurethane) at a Collonate equivalent ratio of 1.0 | 3 parts |
| THF | 100 parts |
| Toluene | 50 parts |

The solution was applied onto a transparent polyester film of about 50 $\mu$m thick (HLS50 by Teijin) using a wire bar coating and dried by heating at 120° C. for three minutes to fabricate a reversible thermosensitive recording layer (of about 10 $\mu$m thick).

The first, second, third, and fourth specific temperature levels of the fabricated recording layer A were 43° C., 90° C., 115° C., and 125° C. respectively.

| (Fabrication of Recording Layer B) | |
|---|---|
| A composition was provided comprising: | |
| 2-anilino-3-methyl-6-dimethyl-aminofluoran (ODB by Hodogaya Chemicals) | 4.5 parts |
| Developer represented by Formula 6 (RP-35 by Miyoshi Oil) | 15 parts |

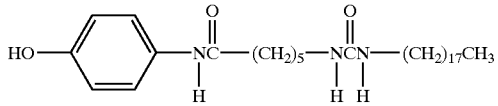

| | |
|---|---|
| Developer represented by Formula 7 (RA-171 by Miyoshi Oil) | 3 parts |

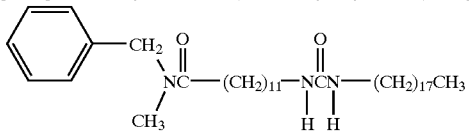

| | |
|---|---|
| Developer represented by Formula 8 (RA-67 by Nippon Chemicals) | 3 parts |
| $C_{18}H_{37}NHCONHC_4H_9$ | 61 parts |
| Acryl polyol resin 50% solution (FR4754 by Mitsubishi Rayon) | |

The composition was milled into particles of 0.1 to 1.5 $\mu$m in diameter using a paint shaker. A resultant dispersion liquid was added with 20 parts of adduct type of hexamethylene-diisocyanate 75% ethyl acetate solution (Collonate HL by Nihon Polyurethane) and stirred to prepare a recording layer solution. The recording layer solution was applied onto a white PET film of 250 $\mu$m thick (which has a magnetic layer at the lower side) made by Nihon Kakoshi using a wire bar coating, dried by heating at 120° C., and heated at 100° C. for ten minutes and 60° C. for forty eight hours to fabricate a recording layer of about 10 $\mu$m thick.

The first, second, third, and fourth specific temperature levels of the fabricated recording layer B were 43° C., 120° C., 170° C., and 190° C. respectively.

| (Preparation of Intermediate Layer Solution) | |
|---|---|
| A solution for intermediate layer was prepared by stirring a mixture of: | |
| Acryl polyol resin 50% solution (LR327 by Mitsubishi Rayon) | 3 parts |
| Zinc oxide particle 30% dispersed solution (ZS303 by Sumitomo Cement) | 7 parts |
| Adduct type of hexamethylene-diisocyanate 75% ethyl acetate solution (Collonate HL by Nihon Polyurethane) | 1.5 parts |
| MEK | 7 parts |
| (Preparation of Protective Layer Solution A) | |
| A composition was provided comprising: | |
| Dipentaerythritol-hexaacrylate (Kayarad DPHA by Nihon Chemicals) | 3 parts |
| Urethane acrylate oligomer (Artresin UN-3320HA by Negami Industries) | 3 parts |
| Dipentaerythritol-caprolactone ester acrylate (Kayarad DPCA-120 by Nippon Chemicals) | 3 parts |
| Talc (LMS-300 by Fuji Talc, at 46 ml/100 g of oil absorption) | 1 part |
| Photo polymerization initiator (Irgacure 184 by Nihon Ciba-Geigy) | 0.5 part |
| Isopropyl alcohol | 11 parts |

The composition was milled to particles of 2 μm in diameter using a paint shaker, stirred, and added with 0.05 part of zinc stearate dispersed to 3.0 μm to prepare a coating solution A.

(Preparation of Protective Layer Solution B)

The same manner as for the protective layer solution A was used for preparing a coating solution B, except that the particle of zinc stearate was 2.0 μm in diameter.

| (Preparation of Protective Layer Solution C) | |
|---|---|
| A composition was provided comprising: | |
| Dipentaerythritol-hexaacrylate (Kayarad DPHA by Nihon Chemicals) | 1.5 parts |
| Urethane acrylate oligomer (Artresin UN-3320HA by Negami Industries) | 4.5 parts |
| Dipentaerythritol-caprolactone ester acrylate (Kayarad DPCA-120 by Nippon Chemicals) | 3 parts |
| Silica (P-526 by Mizusawa Chemicals, at 235 ml/100 g of oil absorption) | 1 part |
| Photo polymerization initiator (Irgacure 184 by Nihon Ciba-Geigy) | 0.5 part |
| Isopropyl alcohol | 11 parts |

The composition was milled to particles of 3 μm in diameter using a paint shaker, stirred, and added with 0.09 part of high purity behenic amaide in 1.0 μm diameter particles (Diamid BL by Nippon Chemicals, at 98° C. of melting point) to prepare a coating solution C.

(Preparation of Protective Layer Solution D)

The same manner as for the protective layer solution C was used for preparing a coating solution D, except that the high purity behenic amaide was zinc stearate (SL-1000 by Sakai Chemicals, at 107° C. of melting point).

| (Preparation of Protective Layer Solution E) | |
|---|---|
| A composition was provided comprising: | |
| Dipentaerythritol-hexaacrylate (Kayarad DPHA by Nihon Chemicals) | 1.5 parts |
| Urethane acrylate oligomer (Artresin UN-3320HA by Negami Industries) | 4.5 parts |

-continued

| (Preparation of Protective Layer Solution E) | |
|---|---|
| Dipentaerythritol-caprolactone ester acrylate (Kayarad DPCA-120 by Nippon Chemicals) | 3 parts |
| Silica (P-526 by Mizusawa Chemicals, at 235 ml/100 g of oil absorption) | 0.5 part |
| Photo polymerization initiator (Irgacure 184 by Nihon Ciba-Geigy) | 0.5 part |
| Isopropyl alcohol | 11 parts |

The composition was milled to particles of 3 μm in diameter using a paint shaker, stirred, and added with 0.5 part of talc (LMS-300 by Fuji Talc, at 46 ml/100 g of oil absorption), 0.06 part of oleic amaide in 1.0 μm diameter particles (Diamid O-200 by Nippon Chemicals, at 75° C. of melting point), and 0.02 part of calcium stearate (SC-1000 by Sakai Chemicals, at 155° C. of melting point) to prepare a coating solution E.

| (Preparation of Protective Layer Solution F) | |
|---|---|
| A coating solution F was prepared by stirring a mixture of: | |
| Urethane acrylate monomer 75% mixture solution (C7-157 by Dainihon Ink) | 10 parts |
| Isopropyl alcohol | 5 parts |
| (Preparation of Protective Layer Solution G) | |
| A composition was provided comprising: | |
| Urethane acrylate monomer 75% mixture solution (C7-157 by Dainihon Ink) | 10 parts |
| Isopropyl alcohol | 5 parts |
| The composition was added and stirred with 0.03 part of polyether denatured dimethyl polysiloxane (BYK-344 by Byk Chemy) to prepare a coating solution G. | |
| (Preparation of Protective Layer Solution H) | |
| A coating solution H was prepared by stirring a mixture of: | |
| Urethane acrylate monomer 75% mixture solution (C7-157 by Dainihon Ink) | 10 parts |
| Silica (P-526 by Mizusawa Chemicals, at 235 ml/100 g of oil absorption) | 0.3 part |
| Isopropyl alcohol | 2.5 parts |
| (Preparation of Protective Layer Solution I) | |
| A composition was provided comprising: | |
| Ester acrylate monomer 60% mixture solution (Z-7010 by JSR, containing talc 1% and silica 0.5%) | 10 parts |
| Isopropyl alcohol | 2.5 parts |

The composition was added and stirred with 0.06 part of calcium stearate in 2.0 μm diameter particles (SC-1000 by Sakai Chemicals, at 155° C. of melting point) to prepare a coating solution I.

EXAMPLE 1

The intermediate layer solution was applied onto the recording layer B using a wire bar, dried at 90° C., and heated at 60° C. for forty eight hours to fabricate an intermediate layer. The protective layer solution A was applied onto the intermediate layer using a wire bar, dried at 90° C. for one minute, and bridged with the use of an 80 W/cm ultraviolet ray lamp to finish a reversible thermosensitive recording medium coated with the protective layer (of about 3 μm thick).

EXAMPLE 2

Another reversible thermosensitive recording medium was fabricated by the same manner as of Example 1, except that the protective layer solution A was replaced by the protective layer solution B.

EXAMPLE 3

A further reversible thermosensitive recording medium was fabricated by the same manner as of Example 1, except that the protective layer solution A was replaced by the protective layer solution C.

EXAMPLE 4

A further reversible thermosensitive recording medium was fabricated by the same manner as of Example 1, except that the protective layer solution A was replaced by the protective layer solution D.

EXAMPLE 5

A further reversible thermosensitive recording medium was fabricated by the same manner as of Example 1, except that the protective layer solution A was replaced by the protective layer solution E.

Comparison 1

The protective layer solution F was applied onto the recording layer A using a wire bar, dried at 90° C. for one minute, and bridged with the use of an 80 W/cm ultraviolet ray lamp to fabricate a reversible thermosensitive recording medium coated with the protective layer (of about 3 μm thick).

Comparison 2

The intermediate layer solution was applied onto the recording layer B using a wire bar, dried at 90° C., and heated at 60° C. for forty eight hours to fabricate the intermediate layer of about 1.5 μm thick. The protective layer solution G was applied onto the intermediate layer using a wire bar, dried at 90° C. for one minute, and bridged with the use of an 80 W/cm ultraviolet ray lamp to finish a reversible thermosensitive recording medium coated with the protective layer (of about 3 μm thick).

Comparison 3

The intermediate layer solution was applied onto the recording layer B using a wire bar, dried at 90° C., and heated at 60° C. for forty eight hours to fabricate the intermediate layer of about 10 μm thick. The protective layer solution H was applied onto the intermediate layer using a wire bar, dried at 90° C. for one minute, and bridged with the use of an 80 W/cm ultraviolet ray lamp to finish a reversible thermosensitive recording medium coated with the protective layer (of about 3 μm thick).

Comparison 4

The intermediate layer solution was applied onto the recording layer B using a wire bar, dried at 90° C., and heated at 60° C. for forty eight hours to fabricate the intermediate layer of about 10 μm thick. The protective layer solution I was applied onto the intermediate layer using a wire bar, dried at 90° C. for one minute, and bridged with the use of an 80 W/cm ultraviolet ray lamp to finish a reversible thermosensitive recording medium coated with the protective layer (of about 3 μm thick).

(Evaluation of Erasing Stability)

Figure 7:
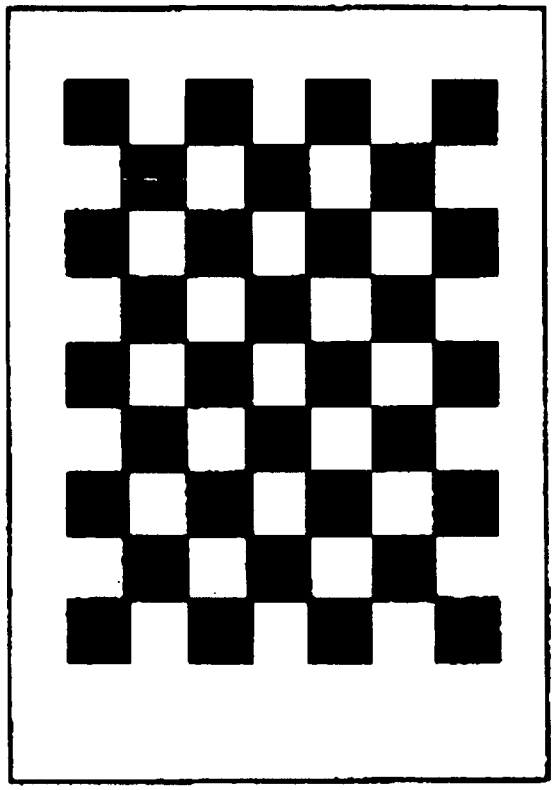
FIG. 7 is a view of a checkerboard pattern used for evaluating the erasing stability on the recording medium of the present invention.

Using a rewritable reader/writer, R-3000 made by Kyushu Matsushita, as the thermosensitive recording apparatus, a cycle of printing and erasing a sample image (a checkerboard pattern shown in FIG. 7) at the print/erase energy setting was repeated five times and their resultant erased surfaces were measured in the reflection density. Also, the sound produced at the erasing process was measured. The print/erase OD level was measured using a Macbeth RD-914. The resultant measurements are shown in Tables 12 and 13.

(Evaluation of Surface Dirt Adhesion)

Some toner was powdered over the surface of each sample. After the toner was removed, its remaining on the surface was inspected by view. Results are shown in Table 13.

TABLE 12

| | temperature level | | | | melting point of lubricant | surface roughness | |
|---|---|---|---|---|---|---|---|
| | 1st | 2nd | 3rd | 4th | (° C.) | Rz | Sm/Rz |
| Ex. 1 | 40 | 120 | 170 | 190 | 107 | 4.02 | 25.3 |
| Ex. 2 | | | | | 107 | 1.24 | 301.2 |
| Ex. 3 | | | | | 98 | 2.50 | 48.2 |
| Ex. 4 | | | | | 107 | 2.72 | 43.6 |
| Ex. 5 | | | | | 75,155 | 2.65 | 51.6 |
| Com. Ex. 1 | 43 | 90 | 115 | 125 | — | not measurable | — |
| Com. Ex. 2 | 40 | 120 | 170 | 190 | — | not measurable | — |
| Com. Ex. 3 | | | | | — | 3.82 | 30.4 |
| Com. Ex. 4 | | | | | 155 | 1.21 | 248.3 |

TABLE 13

| sample/ surface OD | cylce number | erased surface maximum OD | erased surface minimum OD | erased surface average OD | average OD of five cycles | Conveying sound | surface dirt adhesion |
|---|---|---|---|---|---|---|---|
| Ex. 1 | first | 0.10 | 0.08 | 0.09 | 0.10 | fairly | no |
| 0.08 | second | 0.11 | 0.08 | 0.10 | (0.02) | | adhesion |
| | third | 0.10 | 0.08 | 0.09 | | | |
| | fourth | 0.12 | 0.08 | 0.10 | | | |
| | fifth | 0.10 | 0.08 | 0.09 | | | |
| Ex. 2 | first | 0.09 | 0.08 | 0.09 | 0.09 | non | |
| 0.08 | second | 0.09 | 0.08 | 0.09 | (0.01) | | |
| | third | 0.10 | 0.08 | 0.09 | | | |
| | fourth | 0.10 | 0.08 | 0.09 | | | |
| | fifth | 0.09 | 0.08 | 0.09 | | | |

TABLE 13-continued

| sample/ surface OD | cylce number | erased surface maximum OD | erased surface minimum OD | erased surface average OD | average OD of five cycles | Conveying sound | surface dirt adhesion |
|---|---|---|---|---|---|---|---|
| Ex. 3 | first | 0.09 | 0.08 | 0.09 | 0.09 | non | |
| 0.08 | second | 0.09 | 0.08 | 0.09 | (0.01) | | |
| | third | 0.09 | 0.08 | 0.09 | | | |
| | fourth | 0.09 | 0.08 | 0.09 | | | |
| | fifth | 0.10 | 0.08 | 0.09 | | | |
| Ex. 4 | first | 0.09 | 0.08 | 0.09 | 0.09 | non | |
| 0.08 | second | 0.09 | 0.08 | 0.09 | (0.01) | | |
| | third | 0.10 | 0.08 | 0.09 | | | |
| | fourth | 0.10 | 0.08 | 0.09 | | | |
| | fifth | 0.10 | 0.08 | 0.09 | | | |
| Ex. 5 | first | 0.09 | 0.08 | 0.09 | 0.09 | non | |
| 0.08 | second | 0.10 | 0.08 | 0.09 | (0.01) | | |
| | third | 0.10 | 0.08 | 0.09 | | | |
| | fourth | 0.09 | 0.08 | 0.09 | | | |
| | fifth | 0.10 | 0.08 | 0.09 | | | |
| Com. | first | 1.10 | 0.56 | 0.86 | 0.78 | occurring | no |
| Ex. 1. | second | 1.13 | 0.34 | 0.75 | (0.40) | | adhesion |
| 1.08 | third | 0.86 | 0.68 | 0.75 | | | |
| | fourth | 1.17 | 0.54 | 0.96 | | | |
| | fifth | 0.75 | 0.35 | 0.68 | | | |
| Com. | first | 0.13 | 0.09 | 0.12 | 0.12 | fairly | some |
| Ex. 2. | second | 0.12 | 0.10 | 0.11 | (0.04) | | adhesions |
| 0.08 | third | 0.13 | 0.10 | 0.12 | | | |
| | fourth | 0.12 | 0.10 | 0.11 | | | |
| | fifth | 0.12 | 0.10 | 0.11 | | | |
| Com. | first | 0.15 | 0.14 | 0.14 | 0.13 | non | no |
| Ex. 3. | second | 0.15 | 0.13 | 0.14 | (0.05) | | adhesion |
| 0.08 | third | 0.14 | 0.12 | 0.13 | | | |
| | fourth | 0.13 | 0.12 | 0.13 | | | |
| | fifth | 0.13 | 0.12 | 0.13 | | | |
| Com. | first | 0.10 | 0.09 | 0.10 | 0.12 | fairly | no |
| Ex. 4. | second | 0.15 | 0.10 | 0.12 | (0.04) | | adhesion |
| 0.08 | third | 0.11 | 0.09 | 0.10 | | | |
| | fourth | 0.13 | 0.11 | 0.12 | | | |
| | fifth | 0.12 | 0.10 | 0.11 | | | |

OD = optical density

As apparent from the description set forth above, the reversible thermosensitive recording medium of the present invention provides is improved in the thermal head matching, thus ensuring a higher steadiness of the erasing process with minimum erasing errors and increasing the storage capability.

What is claimed is:

1. A reversible thermosensitive recording medium comprising at least a reversible thermo-sensitive recording layer provided on a supporting substrate and, a protective layer provided on the recording layer, wherein the recording layer is arranged so as to develop a first color therein when it is heated to a specific temperature level between a second temperature and a third temperature which is higher than the second temperature and then cooled to a first temperature level between normal temperature and the second temperature which is higher than the normal temperature, while so as to develop a second color therein when it is heated to another temperature level higher than a fourth temperature which is higher than the third temperature and then cooled to a particular temperature which is lower than the first temperature, and the protective layer contains at least a lubricant showing the melting point ranging from higher than or equal to the first temperature to lower than or equal to the second temperature and has a surface roughness (Rz) of 1.2 $\mu$m or more, where Rz represents an average rise on the surface by ten measurements.

2. A reversible thermosensitive recording medium according to claim 1, wherein the protective layer is being cross linked.

3. A reversible thermosensitive recording medium according to claim 1, wherein the lubricant is particles having particle size smaller than or equal to the thickness of the protective layer.

4. A reversible thermosensitive recording medium according to claims 1, wherein the content of the lubricant in the protective layer is higher than or equal to 0.1 and lower than 10.0 percent by weight.

5. A reversible thermosensitive recording medium according to claim 1, wherein the protective layer contains a filler having an oil absorption level of 20 ml/100 g or higher.

6. A reversible thermosensitive recording medium according to claim 1, wherein the surface roughness (Rz) of recording side of the reversible termosensitive recording medium is less than or equal to 5.0 $\mu$m.

7. A reversible thermosensitive recording medium according to claims 1, wherein the surface roughness (Rz) of recording side of the reversible thermosensitive recording medium ranges from 1.5 to 5.0 $\mu$m.

8. A reversible thermosensitive recording medium according to claim 1, wherein the surface roughness ratio (Sm/Rz) (where the Sm represents a smoothness by the distance on average between each projections) of the reversible thermosensitive recording surface of the reversible thermosensitive recording medium ranges from 30 to 120.

9. A reversible thermosensitive recording medium according to claim 1, wherein the strength, which complying to JIS K5400-1990, of the surface film coated on the recording side of the reversible thermosensitive recording medium is higher than or equal to the F.

10. A reversible thermosensitive recording medium according to claim 1, wherein the recording medium has a multiplicity of layers consisting of a supporting substrate layer, thereon interposed a reversible thermosensitive recording layer, thereon interposed an intermediate layer, and thereon interposed a protective layer.

11. A reversible thermosensitive recording medium according to claim 1, wherein all resin materials of recording layer and of thereon provided all layers are a resin or resins which is or are capable of crosslinking.

12. A reversible thermosensitive recording medium according to claim 1, wherein at least one of the layers of the reversible thermosensitive recording medium contains at least one type of filler.

13. A reversible thermosensitive recording medium according to claim 12, wherein the filler in the reversible thermosensitive recording medium is an inorganic filler.

14. A reversible thermosensitive recording medium according to claim 1, wherein the reversible thermosensitive recording medium further comprising information memory means.

15. A reversible thermosensitive recording medium according to claim 14, wherein the information memory means are at least one selected from a group consisting of a magnetic recording layer, a magnetic stripe, an IC memory, and an optical memory, which are accommodated at least a part in the medium.

16. A reversible thermosensitive recording medium according to claims 1, wherein the supporting substrate comprises two or more different sheets being bonded together.

17. A reversible thermosensitive recording medium which comprises a reversible thermosensitive recording portion having a reversible thermosensitive recording medium according to claim 1, a supporting substrate, and thereon provided an adhesive layer.

18. A reversible thermosensitive recording medium according to claim 1, wherein a hard image or images is or are being printed on one or both of the upper and lower sides of the reversible thermosensitive recording medium.

19. A reversible thermosensitive recording method, wherein the method utilizes a reversible thermosensitive recording medium according to claim 1, as a point card, a prepaid card, a clinic card, an entrance card, or a commuter ticket.

20. An image forming method for a reversible thermosensitive recording medium, wherein a reversible thermosensitive recording medium according to claim 1 is heated for developing and/or erasing image.

21. An image forming method for a reversible thermosensitive recording medium according to claim 20, wherein a thermal head is employed as the printing means.

22. An image forming method for a reversible thermosensitive recording medium according to claim 20, wherein the image-erasing means are one of selected from at least a thermal head, a ceramic heater, a heat control, a hot stamp, and a heat block.

* * * * *